US009453678B2

(12) United States Patent
Tetsumoto

(10) Patent No.: US 9,453,678 B2
(45) Date of Patent: Sep. 27, 2016

(54) APPARATUS FOR MANUFACTURING MOLTEN METAL

(75) Inventor: Masahiko Tetsumoto, Kobe (JP)

(73) Assignee: Kobe Steel, Ltd., Kobe-shi (JP)

( * ) Notice: Subject to any disclaimer, the term of this patent is extended or adjusted under 35 U.S.C. 154(b) by 428 days.

(21) Appl. No.: 13/500,790

(22) PCT Filed: Oct. 8, 2010

(86) PCT No.: PCT/JP2010/067791

§ 371 (c)(1),
(2), (4) Date: Apr. 6, 2012

(87) PCT Pub. No.: WO2011/043472

PCT Pub. Date: Apr. 14, 2011

(65) Prior Publication Data

US 2012/0193842 A1 Aug. 2, 2012

(30) Foreign Application Priority Data

Oct. 8, 2009 (JP) ..... 2009-234362
Oct. 8, 2009 (JP) ..... 2009-234363

(51) Int. Cl.
*F27D 99/00* (2010.01)
*F27D 3/00* (2006.01)
(Continued)

(52) U.S. Cl.
CPC ..... *F27B 3/08* (2013.01); *C21B 13/026* (2013.01); *C21B 13/10* (2013.01); *C21B 13/12* (2013.01); *F27B 3/18* (2013.01); *F27B 3/205* (2013.01)

(58) Field of Classification Search
CPC ..... C21C 5/5217; C21C 5/527; C21C 5/52; F27B 3/08; F27B 3/18; F27B 3/24; F27B 3/28; F27B 3/085; F27B 3/225; F27B 3/205; F27B 3/01; F27D 17/00; F27D 19/00; F27D 3/16; F27D 11/08; C21B 11/10; C21B 13/12; C21B 11/00; C21B 13/10; C21B 13/14; C21B 13/026; H05B 7/18
USPC ..... 266/44, 200, 144; 75/10.36, 10.4, 75/10.46, 10.59
See application file for complete search history.

(56) References Cited

U.S. PATENT DOCUMENTS 1,833,321 A 11/1931 Davis
2,068,447 A 1/1937 Cox
(Continued)

FOREIGN PATENT DOCUMENTS

AT 382 355 B 2/1987
EP 0 118 655 A2 9/1984
(Continued)

OTHER PUBLICATIONS

Office Action issued Jul. 11, 2012 in New Zealand Patent Application No. 598672.
(Continued)

*Primary Examiner* — Scott Kastler
*Assistant Examiner* — Michael Aboagye
(74) *Attorney, Agent, or Firm* — Oblon, McClelland, Maier & Neustadt, L.L.P.

(57) ABSTRACT

Disclosed is a production device of which secondary combustion efficiency can be further improved when a molten metal is produced by directly reducing and melting a metal agglomerate raw material layer in an electric heating furnace. Specifically, material charging chutes (4, 4) are disposed at either end portion (2, 2) of a furnace in the width direction of the furnace. Electrodes (5) are disposed in a central region in the furnace width direction. Secondary combustion burners (6) are disposed in an upper portion (1) of the furnace having stepped portions descending from both end portions (2, 2) in the furnace width direction to the electrodes (5). Raw material layers (12) each having a downslope inclined to lower portions of the electrodes (5) are formed in advance by charging a carbonaceous material (A) from the chutes (4, 4), and metal agglomerate raw material layers (13) are formed on the slopes of the raw material layers (12) by charging metal agglomerate raw material (B). Molten iron is produced by sequentially melting lower end portions of the metal agglomerate raw material layers (13) by arc heating at the electrodes (5). At the same time, an oxygen containing gas (C) is blown from the secondary combustion burners (6) so as to cause the combustion of a CO containing gas generated from the metal agglomerate raw material layers (13) while the metal agglomerate raw material layers (13) descend along the slopes of the raw material layers (12), and the metal agglomerate raw material layers (13) are heated by the radiant heat of the combustion.

11 Claims, 6 Drawing Sheets

(51) Int. Cl.

| | |
|---|---|
| ***F27B 3/08*** | (2006.01) |
| ***C21B 13/02*** | (2006.01) |
| ***C21B 13/10*** | (2006.01) |
| ***C21B 13/12*** | (2006.01) |
| ***F27B 3/18*** | (2006.01) |
| ***F27B 3/20*** | (2006.01) |

(56) References Cited

U.S. PATENT DOCUMENTS

| | | | | |
|---|---|---|---|---|
| 3,377,059 | A * | 4/1968 | Ankersen | F27B 3/06 266/204 |
| 3,907,170 | A * | 9/1975 | Schedrin et al. | 406/47 |
| 4,518,419 | A | 5/1985 | Lugscheider et al. | |
| 4,644,557 | A * | 2/1987 | Ebeling et al. | 373/22 |
| 5,681,367 | A | 10/1997 | Hunter | |
| 5,888,458 | A * | 3/1999 | Suwa et al. | 266/44 |
| 6,149,709 | A * | 11/2000 | Uragami et al. | 75/504 |
| 6,284,018 | B1 | 9/2001 | Uragami et al. | |
| 6,419,724 | B1 | 7/2002 | Monteyne | |
| 6,614,831 | B2 * | 9/2003 | Shver | 373/66 |
| 6,689,182 | B2 * | 2/2004 | Tokuda et al. | 75/10.66 |
| 6,797,034 | B2 * | 9/2004 | Sugitatsu et al. | 75/484 |
| 2003/0070507 | A1 | 4/2003 | Tokuda et al. | |
| 2011/0036201 | A1 | 2/2011 | Tetsumoto | |

FOREIGN PATENT DOCUMENTS

| | | |
|---|---|---|
| EP | 0 171 385 A1 | 2/1986 |
| JP | 51 78711 | 7/1976 |
| JP | 59 134482 | 8/1984 |
| JP | 2000 513411 | 10/2000 |
| JP | 2001 515138 | 9/2001 |
| JP | 2001 525487 | 12/2001 |
| JP | 2003 105415 | 4/2003 |
| JP | 2009 280910 | 12/2009 |
| TW | 564261 B | 12/2003 |

OTHER PUBLICATIONS

Office Action issued Jul. 12, 2012 in New Zealand Patent Application No. 601164.

U.S. Appl. No. 13/501,068, filed Apr. 9, 2012, Tetsumoto.

Kazakhstan Office Action issued May 4, 2013 in Patent Application No. 2012/1608.1 with English Translation.

Kazakhstan Office Action issued May 4, 2013 in Patent Application No. 2012/1550.1 with English Translation.

International Search Report issued on Dec. 14, 2010 in PCT/JP10/067791 filed on Oct. 8, 2010.

Office Action issued Jan. 28, 2013 in Taiwanese Patent Application No. 099134401.

Japanese Office Action issued Sep. 17, 2013, in Japan Patent Application No. 2009-234362 (with English translation).

Partial European Search Report issued Jul. 27, 2015 in Patent Application No. 10822142.5.

Supplementary European Search Report issued Dec. 11, 2015 in EP 10822142 filed Oct. 8, 2010.

* cited by examiner

APPARATUS FOR MANUFACTURING MOLTEN METAL

TECHNICAL FIELD

The present invention relates to an improvement of an apparatus for manufacturing molten metal by directly reducing and melting a metal agglomerate raw material such as metal oxide agglomerates with carbonaceous material in an electric heating and melting furnace without conducting pre-reduction.

BACKGROUND ART

Various proposals have been made for new iron-making processes that substitute existing blast furnace and smelting reduction processes. These proposals relate to the molten metal manufacturing processes for obtaining molten metal, involving pre-reducing metal oxide agglomerates with carbonaceous material in a rotary hearth furnace to form reduced agglomerates and melting the reduced agglomerates in an electric furnace such as an arc furnace or a submerged arc furnace (for example, refer to Patent Literatures 1 to 4).

However, in the existing processes, two steps (a pre-reduction step using a rotary hearth furnace and a melting step using a melting furnace) must be provided. These processes require equipment or facilities for transferring the reduced agglomerates from the rotary hearth furnace to the melting furnace as well as two exhaust gas processing lines, i.e., one for the rotary hearth furnace and one for the melting furnace. Thus, the facility cost increases, the thermal loss increases, and the energy consumption cannot be sufficiently decreased as total system or process.

The inventor of the present invention has performed thorough studies to provide a specific method for manufacturing molten metal in which a rotary hearth furnace is not used and an electric heating furnace only is used to reduce and melt metal oxide agglomerates with carbonaceous material. As a result, the inventor accomplished an invention described below and filed a patent application for the invention (Japanese Patent Application No. 2009-105397; hereafter, the invention of this patent application is referred to as "earlier invention".)

An apparatus for manufacturing molten metal according to the earlier invention is illustrated in FIGS. 5A and 5B. A stationary non-tilting electric heating furnace, herein, an arc furnace is used that includes raw material charging chutes 4 at both ends 2 of the furnace in the width direction, an electrode 5 in the center position of the furnace in the width direction, and a secondary combustion burner 6 provided in a flat furnace top 1. A carbonaceous material A is charged through the chutes 4 to form a carbonaceous material layer (corresponding to "raw material layer" of the subject invention) 12 having a sloping surface extending downward toward the lower portion of the electrode 5. Metal oxide agglomerates with carbonaceous material B are subsequently charged to form an agglomerate layer (corresponding to "metal agglomerate raw material layer" of the subject invention) 13 on the sloping surface of the carbonaceous material layer 12. Arc heating is then conducted with the electrode 5 to sequentially melt the lower end portion of the agglomerate layer 13 to form a molten metal layer 14 and a molten slag layer 15. At the same time, while the agglomerate layer 13 is allowed to descend along the sloping surface of the carbonaceous material layer 12, the agglomerate layer 13 is heated with radiant heat from secondary combustion by blowing oxygen-containing gas C through the secondary combustion burner 6 to burn CO-containing gas generated from the agglomerate layer 13.

According to the earlier invention, while an agglomerate layer is allowed to move along the sloping surface of a raw material layer formed in a furnace toward an electrode, the agglomerate layer is pre-reduced by heating with radiant heat from secondary combustion by blowing oxygen-containing gas through a secondary combustion burner to burn CO-containing gas generated from the agglomerate layer; and the pre-reduced agglomerate layer is reduced and melted near the electrode by arc heating to form molten metal. Thus, molten metal is directly obtained from metal oxide agglomerates with carbonaceous material by a single process and hence the facility cost and the energy consumption can be considerably decreased, compared with the existing processes.

However, an apparatus for manufacturing molten metal according to the earlier invention needs to be improved in the mixing of CO-containing gas generated in the furnace and the oxygen-containing gas C blown through the secondary combustion burner 6 provided in the flat furnace top 1. Thus, a further increase in the secondary combustion efficiency and ultimately a further increase in the energy efficiency have been demanded.

When a large amount of oxygen-containing gas C is blown from the flat furnace top 1, the gas is brought into contact with the electrode 5 to seriously wear the electrode 5. Accordingly, a partition wall 9 is provided between the electrode 5 and the secondary combustion burner 6. Although the wear of the electrode 5 is suppressed with the partition wall 9, the problem that the partition wall 9 is damaged remains unresolved.

It is difficult to introduce oxygen-containing gas C from an end 2 of the furnace in the width direction because the carbonaceous material layer 12 is present. It is possible to introduce oxygen-containing gas C from an end of the furnace in the longitudinal direction because the gas can be blown into the furnace so as to avoid the carbonaceous material layer 12. However, it is difficult to distribute oxygen-containing gas C over the entirety of the furnace in the longitudinal direction and hence the secondary combustion efficiency becomes poor.

In an apparatus for manufacturing molten metal according to the earlier invention, when agglomerates charged into the furnace have large amounts of powder or agglomerates are sintered or fused together in the furnace, hanging of the agglomerate layer may occur and smooth descent of the agglomerate layer may be inhibited. In this case, agglomerates are not properly reduced or melted by heating and the performance of the apparatus is degraded. When such hanging of the agglomerate layer occurs, it is difficult to provide a mechanical unit that forcedly overcomes the hanging in an apparatus for manufacturing molten metal according to the earlier invention.

CITATION LIST

Patent Literature

PTL 1: Japanese Unexamined Patent Application Publication (Translation of PCT Application) No. 2000-513411

PTL 2: Japanese Unexamined Patent Application Publication (Translation of PCT Application) No. 2001-515138

PTL 3: Japanese Unexamined Patent Application Publication (Translation of PCT Application) No. 2001-525487

PTL 4: Japanese Unexamined Patent Application Publication No. 2003-105415

SUMMARY OF INVENTION

Technical Problem

An object of the present invention is to provide an apparatus for manufacturing molten metal by directly reducing and melting a metal agglomerate raw material such as metal oxide agglomerates with carbonaceous material in an electric heating and melting furnace without conducting pre-reduction, the apparatus allowing for a higher secondary combustion efficiency.

Another object of the present invention is to provide an apparatus for manufacturing molten metal in which hanging of a metal agglomerate raw material layer in the furnace can be readily and reliably overcome with a mechanical unit.

Solution to Problem

A first aspect of the present invention provides an apparatus for manufacturing molten metal, including a stationary non-tilting electric furnace including electric heating means, wherein an exhaust gas duct and a raw material charging chute are connected to a furnace top of the furnace, the raw material charging chute is provided in one end of the furnace in the width direction, the electric heating means is provided such that an electric heating region heated with the electric heating means is in the other end of the furnace in the width direction, a secondary combustion burner is provided in the furnace top; the apparatus is configured to manufacture molten metal by forming a raw material layer by charging a particular amount of a carbonaceous material and/or a metal agglomerate raw material into the furnace from the raw material charging chute, the raw material layer having a sloping surface extending downward from the one end of the furnace in the width direction toward the electric heating region, by subsequently forming a metal agglomerate raw material layer on the sloping surface of the raw material layer by continuously or intermittently charging the metal agglomerate raw material into the furnace from the raw material charging chute, and by subsequently forming a molten metal layer and a molten slag layer in the furnace by sequentially melting the metal agglomerate raw material near a lower end portion of the metal agglomerate raw material layer by electric heating with the electric heating means while allowing the metal agglomerate raw material layer to descend along the sloping surface of the raw material layer, and concurrently thermally reducing the metal agglomerate raw material layer by radiant heat from secondary combustion by blowing oxygen-containing gas into a space, within the furnace, above the metal agglomerate raw material layer from the secondary combustion burner to burn CO-containing gas generated from the metal agglomerate raw material layer; and the furnace top includes a sloping furnace top that generally slopes downward from the one end of the furnace in the width direction to the other end of the furnace in the width direction.

The term "generally slopes downward" means that regions that do not slope downward, for example, a horizontal region and a vertical region may be locally present, but, as a whole, a downslope is provided (hereafter, the same definition).

A second aspect of the present invention provides an apparatus for manufacturing molten metal, including a stationary non-tilting electric furnace including electric heating means, wherein an exhaust gas duct and raw material charging chutes are connected to a furnace top of the furnace, the raw material charging chutes are provided in both ends of the furnace in the width direction, the electric heating means is provided such that an electric heating region heated with the electric heating means is in a center position of the furnace in the width direction, a secondary combustion burner is provided in the furnace top; the apparatus is configured to manufacture molten metal by forming a raw material layer by charging a particular amount of a carbonaceous material and/or a metal agglomerate raw material into the furnace from the raw material charging chutes provided in both ends of the furnace in the width direction, the raw material layer having sloping surfaces extending downward from both ends of the furnace in the width direction toward the electric heating region, by subsequently forming a metal agglomerate raw material layer on the sloping surfaces of the raw material layer by continuously or intermittently charging the metal agglomerate raw material into the furnace from the raw material charging chutes provided in both ends of the furnace in the width direction, and by subsequently forming a molten metal layer and a molten slag layer in the furnace by sequentially melting the metal agglomerate raw material near a lower end portion of the metal agglomerate raw material layer by electric heating with the electric heating means while allowing the metal agglomerate raw material layer to descend along the sloping surfaces of the raw material layer, and concurrently heating the metal agglomerate raw material layer by radiant heat from secondary combustion by blowing oxygen-containing gas into a space, within the furnace, above the metal agglomerate raw material layer from the secondary combustion burner to burn CO-containing gas generated from the metal agglomerate raw material layer; and the furnace top includes a sloping furnace top that generally slopes downward from both ends of the furnace in the width direction to the center position of the furnace in the width direction.

The sloping furnace top may have a slanting-surface structure.

The sloping furnace top may have a stepped structure.

The sloping angle of the sloping furnace top may be in a range of [collapse angle of the metal agglomerate raw material−15°] or more and [static angle of repose of the metal agglomerate raw material+15°] or less.

The electric heating means may include an electrode inserted through the furnace top into the furnace and the secondary combustion burner may be provided in the furnace top at an angle such that the oxygen-containing gas blown through the secondary combustion burner flows away from the electrode.

A gas blowing portion of the secondary combustion burner may have a configuration such that the oxygen-containing gas blown through the secondary combustion burner swirls about the axis of the secondary combustion burner.

The metal agglomerate raw material may be one or more selected from the group consisting of metal oxide agglomerates with carbonaceous material, metal scrap, reduced metal, metal oxide agglomerate ore, metal chloride agglomerates with carbonaceous material, and metal oxide ore agglomerates.

A third aspect of the present invention provides an apparatus for manufacturing molten metal, including a stationary non-tilting electric furnace including electric heating means, wherein an exhaust gas duct and a raw material charging chute are connected to a furnace top of the furnace, the raw material charging chute is provided in one end of the furnace in the width direction, the electric heating means is provided such that an electric heating region heated with the electric heating means is in the other end of the furnace in the width direction, a secondary combustion burner is provided in the furnace top; the apparatus is configured to manufacture molten metal by forming a raw material layer by charging a particular amount of a carbonaceous material and/or a metal agglomerate raw material into the furnace from the raw material charging chute, the raw material layer having a sloping surface extending downward from the one end of the furnace in the width direction toward the electric heating region, by subsequently forming a metal agglomerate raw material layer on the sloping surface of the raw material layer by continuously or intermittently charging the metal agglomerate raw material into the furnace from the raw material charging chute, and by subsequently forming a molten metal layer and a molten slag layer in the furnace by sequentially melting the metal agglomerate raw material near a lower end portion of the metal agglomerate raw material layer by electric heating with the electric heating means while allowing the metal agglomerate raw material layer to descend along the sloping surface of the raw material layer, and concurrently thermally reducing the metal agglomerate raw material layer by radiant heat from secondary combustion by blowing oxygen-containing gas into a space, within the furnace, above the metal agglomerate raw material layer from the secondary combustion burner to burn CO-containing gas generated from the metal agglomerate raw material layer; and a furnace bottom of the stationary non-tilting electric furnace includes a sloping furnace bottom that generally slopes downward from the one end of the furnace in the width direction to the other end of the furnace in the width direction.

The term "generally slopes downward" means that regions that do not slope downward, for example, a horizontal region and a vertical region may be locally present, but, as a whole, a downslope is provided (hereafter, the same definition).

A fourth aspect of the present invention provides an apparatus for manufacturing molten metal, including a stationary non-tilting electric furnace including electric heating means, wherein an exhaust gas duct and raw material charging chutes are connected to a furnace top of the furnace, the raw material charging chutes are provided in both ends of the furnace in the width direction, the electric heating means is provided such that an electric heating region heated with the electric heating means is in a center position of the furnace in the width direction, a secondary combustion burner is provided in the furnace top; the apparatus is configured to manufacture molten metal by forming a raw material layer by charging a particular amount of a carbonaceous material and/or a metal agglomerate raw material into the furnace from the raw material charging chutes provided in both ends of the furnace in the width direction, the raw material layer having sloping surfaces extending downward from both ends of the furnace in the width direction toward the electric heating region, by subsequently forming a metal agglomerate raw material layer on the sloping surfaces of the raw material layer by continuously or intermittently charging the metal agglomerate raw material into the furnace from the raw material charging chutes provided in both ends of the furnace in the width direction, and by subsequently forming a molten metal layer and a molten slag layer in the furnace by sequentially melting the metal agglomerate raw material near a lower end portion of the metal agglomerate raw material layer by electric heating with the electric heating means while allowing the metal agglomerate raw material layer to descend along the sloping surfaces of the raw material layer, and concurrently heating the metal agglomerate raw material layer by radiant heat from secondary combustion by blowing oxygen-containing gas into a space, within the furnace, above the metal agglomerate raw material layer from the secondary combustion burner to burn CO-containing gas generated from the metal agglomerate raw material layer; and a furnace bottom of the stationary non-tilting electric furnace includes a sloping furnace bottom that generally slopes downward from both ends of the furnace in the width direction to the center position of the furnace in the width direction.

The sloping furnace bottom may have a slanting-surface structure.

The sloping furnace bottom may have a stepped structure.

The sloping angle of the sloping furnace bottom may be in a range of [collapse angle of the metal agglomerate raw material−25°] or more and [static angle of repose of the metal agglomerate raw material+5°] or less.

A shock generator that mechanically overcomes hanging of the metal agglomerate raw material layer may be disposed, within the furnace, between the sloping furnace bottom and the surface of the metal agglomerate raw material layer.

The shock generator may include a shaft having a rotational axis lying in the longitudinal direction of the furnace and a disintegrating member protruding from the surface of the shaft.

The shock generator may rotate about the rotational axis in one direction only in which the metal agglomerate raw material layer descends or alternately in the direction in which the metal agglomerate raw material layer descends and in a direction opposite to the direction.

The sloping furnace bottom may include a slanting-surface portion and a stepped portion that are alternately located in the longitudinal direction of the furnace, a plurality of shock generators that mechanically overcome hanging of the metal agglomerate raw material layer may be disposed at least in the longitudinal direction of the furnace, within the furnace, between the sloping furnace bottom and the surface of the metal agglomerate raw material layer, the shock generators may include a shaft having a rotational axis lying in the longitudinal direction of the furnace and a disintegrating member protruding from the surface of the shaft, at least one end of the shaft may be supported by a bearing disposed, outside the furnace, below the slanting-surface portion of the sloping furnace bottom, and a portion of the shaft from which the disintegrating member is protruded may be disposed, inside the furnace, above the stepped portion of the sloping furnace bottom.

Advantageous Effects of Invention

According to the present invention, the furnace top is formed so as to include a portion that generally slopes downward from an end of the furnace in the width direction to the electric heating means. As a result, the volume of a space (free space), within the furnace, above the metal agglomerate raw material layer is decreased, compared with the earlier invention. Thus, mixing of CO-containing gas generated in the furnace and oxygen-containing gas blown from the secondary combustion burner provided in the furnace top is promoted. As a result, the secondary combustion efficiency is increased and the energy efficiency of the total process is increased.

The furnace top is formed so as to include a portion that generally slopes upward, viewed from the electrode, toward an end of the furnace in the width direction. As a result, when the electrode is used as the electric heating means, oxygen-containing gas blown from the secondary combustion burner disposed in the furnace top tends to flow away from the electrode without partition walls disposed between the secondary combustion burner and the electrode. Thus, wear of the electrode can be suppressed.

According to the present invention, the furnace bottom is formed so as to include a portion that generally slopes downward from an end of the furnace in the width direction to a region including the electric heating means, that is, the other end of the furnace in the width direction or the center position of the furnace in the width direction. As a result, the distance between the furnace bottom and the metal agglomerate raw material layer can be shortened. Accordingly, even when hanging of the metal agglomerate raw material layer is caused, the hanging of the metal agglomerate raw material layer can be readily and reliably overcome by applying a physical force with a mechanical unit through an opening to the outside of the furnace in the portion that generally slopes downward.

As described above, the furnace bottom is formed so as to include a portion that generally slopes downward. As a result, the internal volume of the whole furnace is decreased and the amount of charged materials held in the furnace is decreased. Thus, the degree to which powder built up in the raw material layer is compacted by the weight of the charged materials is reduced and accretion of the whole raw material layer is suppressed. In addition, economical design of the furnace is made possible in view of the strength of the furnace body.

DESCRIPTION OF EMBODIMENTS

Hereinafter, an embodiment of the present invention will be described in detail with reference to drawings.

Figure 1A:
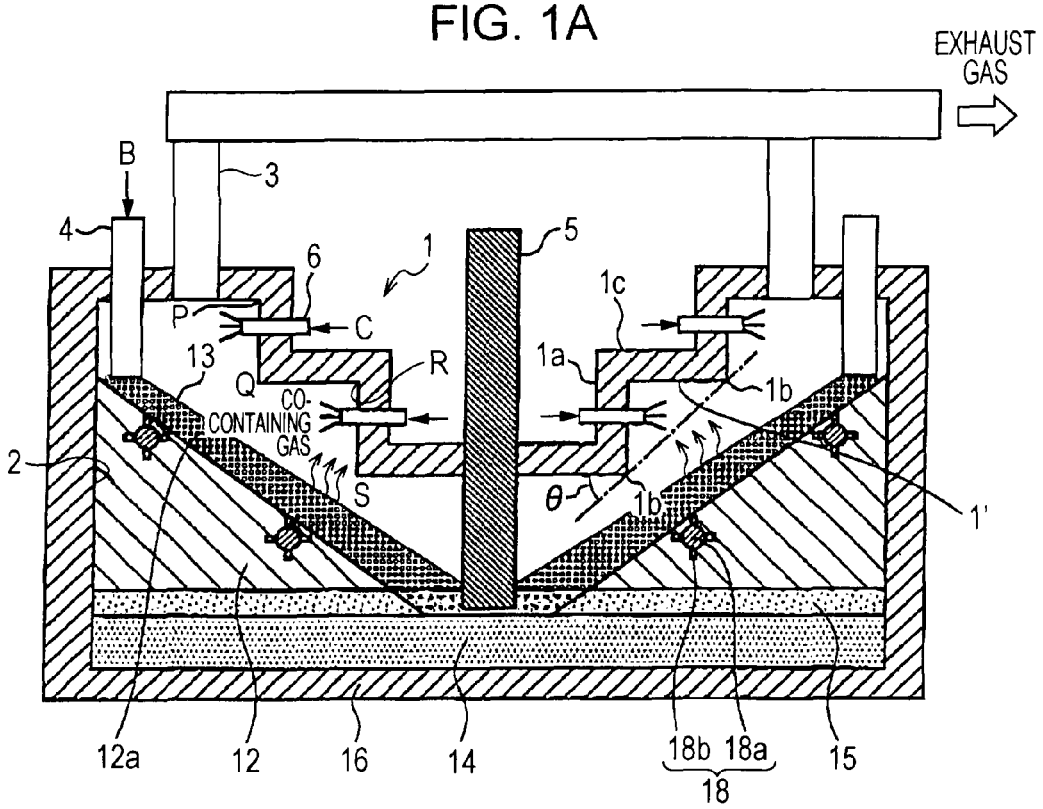
FIG. 1A is a cross-sectional view in the width direction, illustrating an outline configuration of an apparatus for manufacturing molten metal according to an embodiment of the present invention.
Figure 1B:
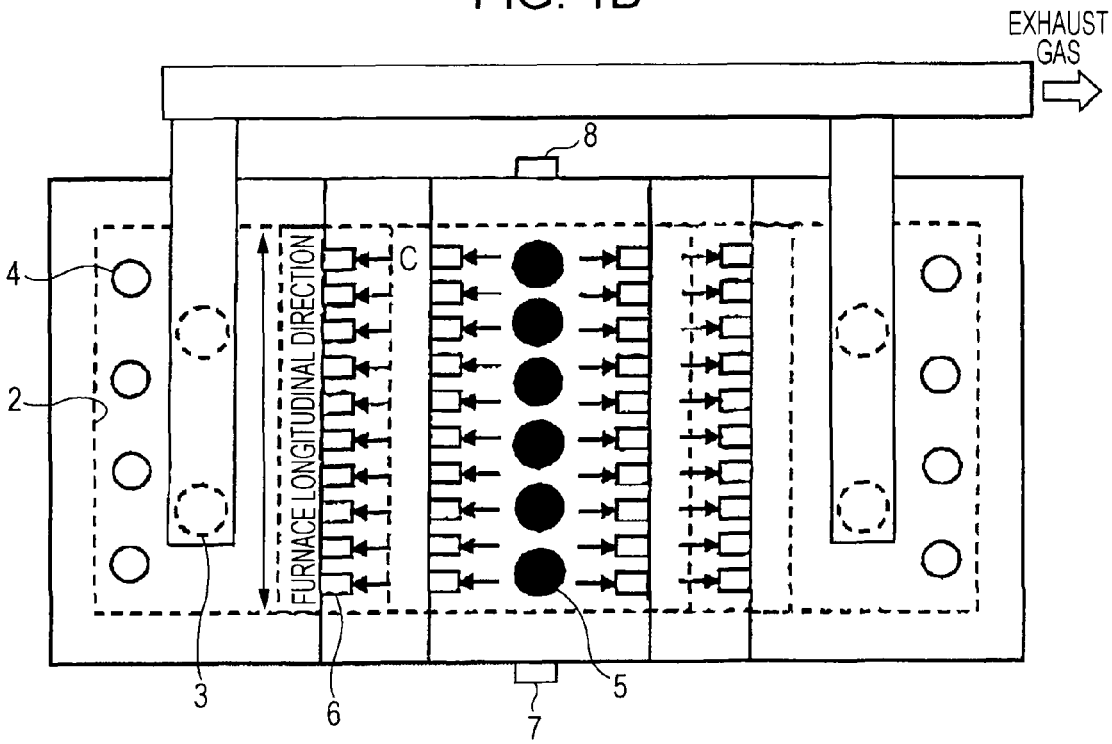
FIG. 1B is a plan view illustrating an outline configuration of an apparatus for manufacturing molten metal according to an embodiment of the present invention.
Figure 1C:
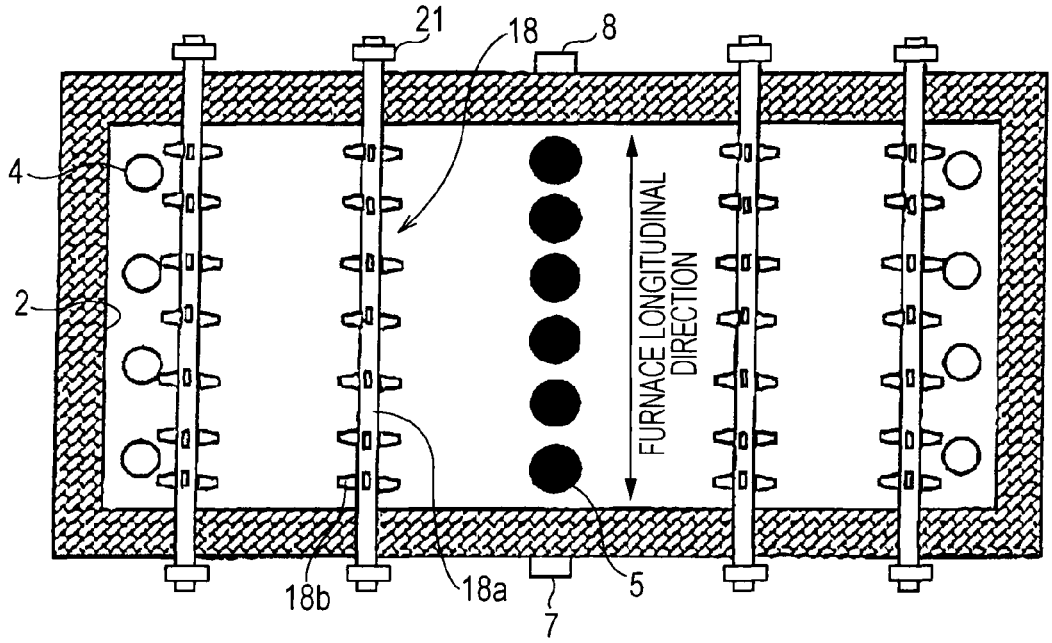
FIG. 1C is a partial horizontal-sectional view illustrating an outline configuration of an apparatus for manufacturing molten metal according to an embodiment of the present invention.

FIGS. 1A, 1B, and 1C illustrate an outline configuration of an apparatus for manufacturing molten metal according to an embodiment of the present invention. The apparatus of the embodiment includes a stationary non-tilting electric furnace (also simply referred to as "furnace" hereinafter). This furnace is an arc furnace having a predominately rectangular shape in a horizontal cross-section. A furnace top 1 has a sloping portion (sloping furnace top) 1' that slopes downward from an end 2 of the furnace in the width direction to the center position of the furnace in the width direction. In the embodiment, a furnace that has a sloping furnace top 1' having a stepped structure (zigzag line formed by connecting points P, Q, R, and S in the embodiment) will be described. An exhaust gas duct 3 and raw material charging chutes 4 are connected to the furnace top (furnace top 1 in the embodiment). Electrodes 5 that function as electric heating means (heaters) are inserted through the furnace top 1 into the furnace. The raw material charging chutes 4 are provided in both ends 2 of the furnace in the width direction while the electrodes 5 are provided in the center position of the furnace in the width direction. Secondary combustion burners 6 are provided in rising portions 1*a* of the stepped structure of the furnace top 1.

The exhaust gas duct 3 is preferably provided closer to the raw material charging chutes 4 than to the electrodes 5. This is to suppress oxidizing exhaust gas after secondary combustion from flowing toward the electrodes 5 and to thereby suppress damage on the electrodes 5.

In the embodiment, the furnace top 1 is formed so as to have the sloping portion (sloping furnace top) 1' that generally slopes upward, viewed from the electrodes 5, that is, the center position of the furnace in the width direction, toward the ends 2 of the furnace in the width direction. As a result, the oxidizing exhaust gas after secondary combustion flows through a space (free space) that is formed between the sloping furnace top 1' and a metal agglomerate raw material layer 13 and that generally slopes upward toward the ends 2 of the furnace in the width direction, to the exhaust gas duct 3. Thus, the contact between the exhaust gas and the electrodes 5 is reliably suppressed to thereby suppress damage on the electrodes 5.

Figure 5A:
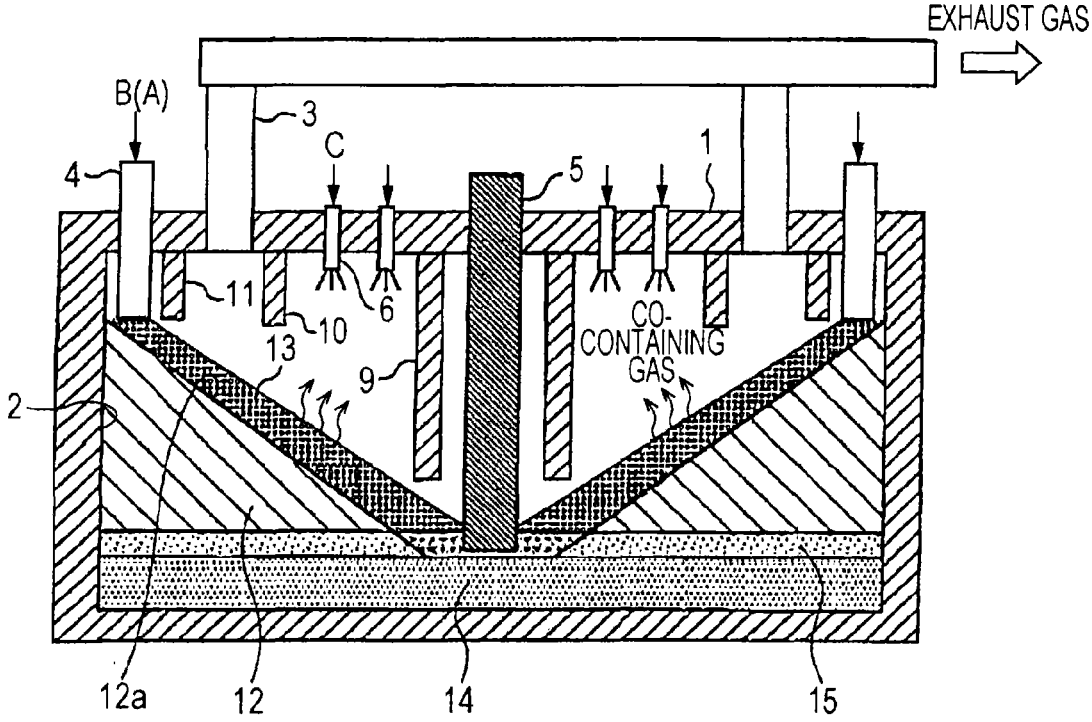
FIG. 5A Background Art
FIG. 5A is a cross-sectional view in the width direction, illustrating an outline configuration of an apparatus for manufacturing molten metal according to the earlier invention.
Figure 5B:
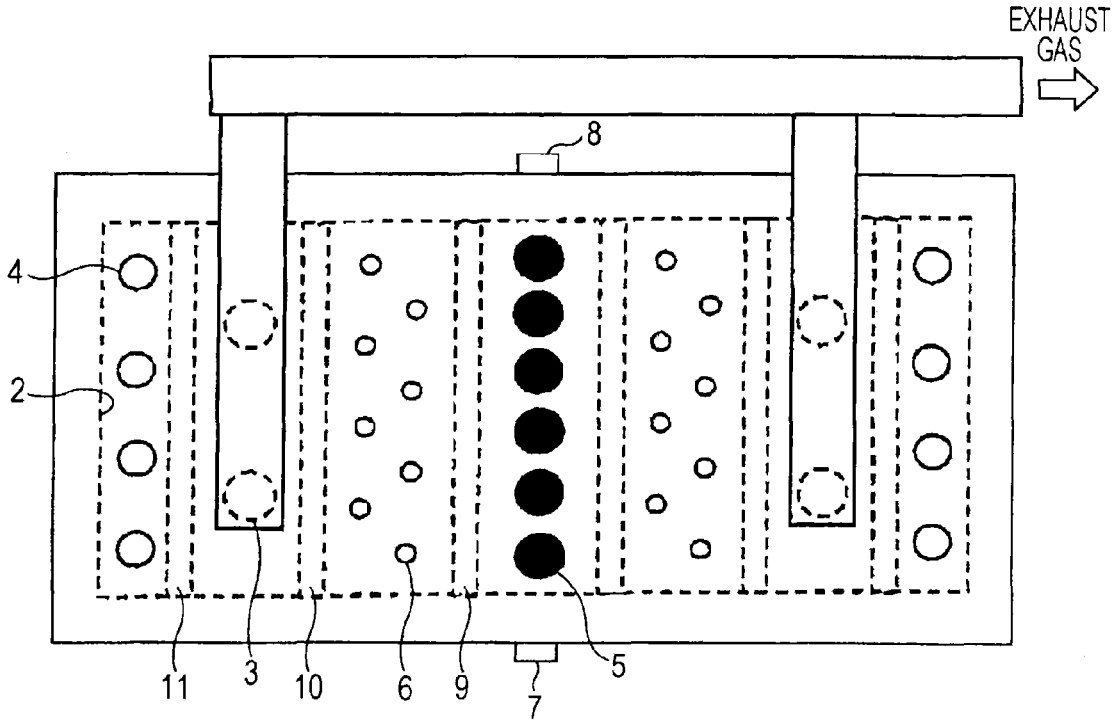
FIG. 5B Background Art
FIG. 5B is a plan view illustrating an outline configuration of an apparatus for manufacturing molten metal according to the earlier invention.

In an apparatus for manufacturing molten metal according to the earlier invention in FIGS. 5A and 5B, to reliably prevent the oxidizing exhaust gas after secondary combustion from contacting the electrodes 5, the partition walls 9 suspending in the furnace are preferably disposed between the electrodes 5 and the secondary combustion burners 6. In contrast, the partition walls 9 may be omitted in the embodiment due to the above-described advantageous effect.

In the earlier invention in FIGS. 5A and 5B, to prevent the exhaust gas after secondary combustion from short-cutting to the exhaust gas duct 3 and to transfer a sufficient amount of radiant heat to the metal agglomerate raw material layer 13, the partition walls 10 are preferably disposed between the secondary combustion burners 6 and the exhaust gas duct 3. In contrast, since the sloping furnace top 1' is provided in the embodiment in FIG. 1A, the furnace top 1 is made to be close to and conform to the surface of the metal agglomerate raw material layer 13. As a result, the exhaust gas after secondary combustion flows through a route close to the surface of the metal agglomerate raw material layer 13 and hence the metal agglomerate raw material layer 13 is sufficiently heated with radiant heat from secondary combustion. Accordingly, the partition walls 10 may also be omitted in the embodiment.

Figure 2A:
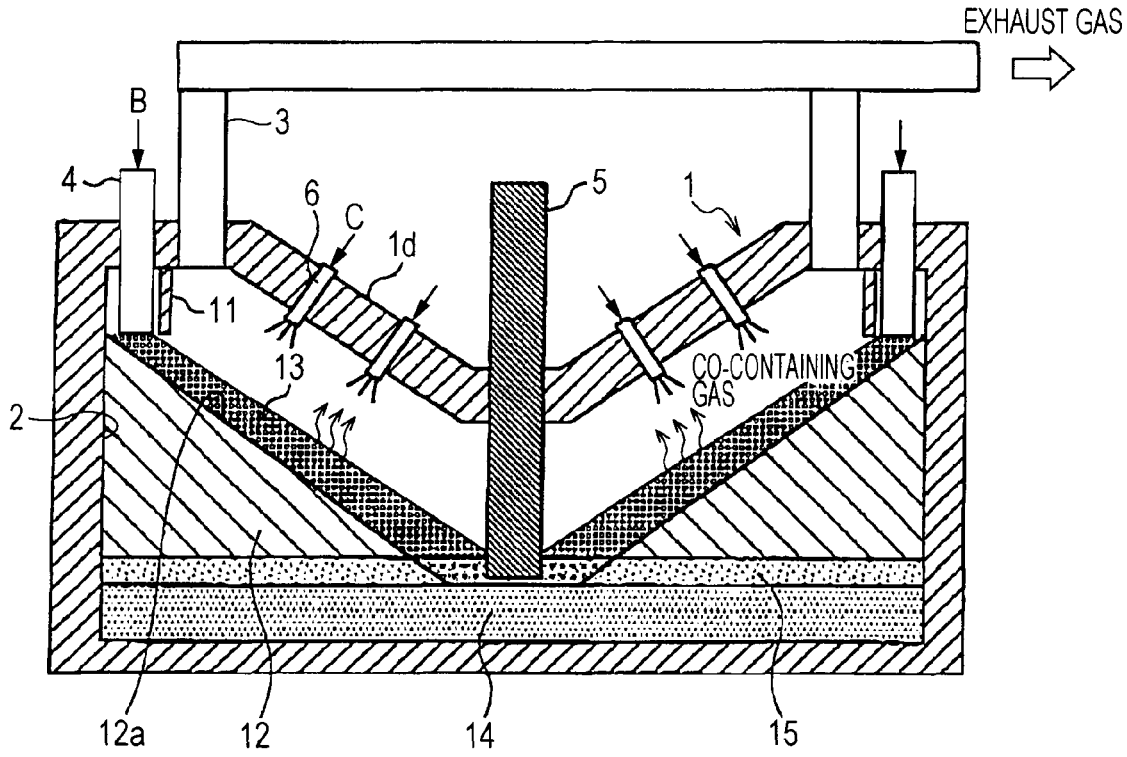
FIG. 2A is a cross-sectional view in the width direction, illustrating an outline configuration of an apparatus for manufacturing molten metal according to another embodiment of the present invention.

As in the earlier invention, to prevent damage on the raw material charging chutes 4 caused by overheating with hot exhaust gas, the partition walls 11 are preferably disposed between the exhaust gas duct 3 and the raw material charging chutes 4 as illustrated in FIG. 2A (not shown in FIG. 1A).

As described above, since at least the partition walls 9 and 10 may be omitted in the embodiment, problems caused by damage on the partition walls can be reduced.

To prevent oxygen-containing gas C blown through the secondary combustion burners 6 from short-cutting along the furnace top 1 to the exhaust gas duct 3, the height of the space that is formed between the furnace top 1 and the metal agglomerate raw material layer 13 is preferably made as constant as possible in the furnace in the width direction. Accordingly, the sloping angle of the sloping furnace top 1' is preferably made as close as possible to the sloping angle of the surface of the metal agglomerate raw material layer 13. Since the sloping angle of the surface of the metal agglomerate raw material layer 13 is an angle between the collapse angle and the static angle of repose of metal agglomerate raw material B, the sloping angle of the sloping furnace top 1' is preferably in the range of [the collapse angle of metal agglomerate raw material B−15° (more preferably −10°, still more preferably −5°)] or more and [the static angle of repose of metal agglomerate raw material B+15° (more preferably +10°, still more preferably +5°)] or less. The sloping angle of the sloping furnace top 1' having a stepped structure is defined as the sloping angle (θ in FIG. 1A) of a line connecting edges (1*b* in FIG. 1A), within the furnace, of the steps of the stepped structure.

Oxygen-containing gas C blown through the secondary combustion burners 6 and CO-containing gas generated from the metal agglomerate raw material layer 13 become turbulent due to the stepped structure of the sloping furnace top 1 and hence these gases are further mixed.

The secondary combustion burners 6 are preferably disposed in the sloping furnace top 1' at an angle such that oxygen-containing gas C blown through the secondary combustion burners 6 flows away from the electrodes 5. As a result, exhaust gas after secondary combustion is further suppressed from contacting the electrodes 5. The direction in which oxygen-containing gas C is blown through the secondary combustion burners 6 is preferably adjusted in the range of 10° to 135° away from the electrodes 5 with reference to the vertical downward direction (0°). When the angle is less than 10°, flows to the electrodes 5 are not sufficiently suppressed. When the angle is more than 135°, lining refractories of a step 1*c* of the stepped structure tend to be damaged. The angle is more preferably 30° to 120°, still more preferably 45° to 105°.

In the embodiment, the secondary combustion burners 6 are perpendicularly disposed in the rising portions 1*a* of the stepped structure so that oxygen-containing gas C is blown in a direction (at 90° with reference to the vertical downward direction) that is diametrically opposite to the electrodes 5.

The gas blowing portions of the secondary combustion burners 6 preferably have a configuration such that oxygen-containing gas C blown through the secondary combustion burners 6 swirls about the axes of the secondary combustion burners 6. As a result, the secondary combustion of CO-containing gas is further accelerated. The secondary combustion burners 6 that provide swirls about the axes of the burners may be, for example, swirl nozzle burners having blowing openings whose blowing directions are eccentric or burners having spiral grooves at their tips.

A shock generator 18 that mechanically overcomes hanging of the metal agglomerate raw material layer 13 is preferably disposed, within the electric furnace, between a furnace bottom 16 of the furnace and the surface of the metal agglomerate raw material layer 13. The "shock generator" is a device that continuously or intermittently applies an external force to the metal agglomerate raw material layer 13.

The shock generator 18 may be constituted by, for example, a shaft 18*a* having a rotational axis lying in the longitudinal direction of the furnace and disintegrating members 18*b* protruding from the surface of the shaft 18*a* (the shock generator 18 may be similar to a burden feeder that is disposed within a shaft furnace for Midrex direct reduction process and is used to prevent hanging of reduced iron). By rotating the shaft 18*a* of the shock generator 18 continuously or intermittently at regular intervals, hanging of the metal agglomerate raw material layer 13 can be suppressed. Even if hanging of the metal agglomerate raw material layer 13 occurs, sintered or fused metal agglomerate raw material B can be disintegrated with the disintegrating members 18*b* protruding from the shaft 18*a*; even when the sintered or fused material is not sufficiently disintegrated, the metal agglomerate raw material layer 13 can be forcedly transported downward (lowered) toward the lower portions of the electrodes 5 before the sintered or fused material becomes coarse; accordingly, the operation can be smoothly performed for a long period of time.

To effectively provide such a function in response to the occurrence of hanging, the shock generator 18 that is similar to the burden feeder may be properly selected from a shock generator that rotates about its rotational axis in one direction (normal direction) only in which the metal agglomerate raw material layer 13 descends and a shock generator that alternately rotates about its rotational axis in the direction (normal direction) in which the metal agglomerate raw material layer 13 descends and in the opposite direction. The former shock generator is intended to perform transportation, whereas the latter shock generator is intended to perform disintegration.

In the furnace bottom, a tap hole 7 and a slag tap hole 8 are preferably provided in furnace side walls in the furnace longitudinal direction perpendicular to the furnace width direction, e.g., in furnace side walls in the furnace longitudinal direction where the raw material charging chutes 4 are not provided (i.e., where raw material layers 12 are not provided in the furnace). This is to facilitate the hole-opening operation during the tapping of molten metal and the slag.

Common heat-exchangers (not shown) may be installed downstream of the exhaust gas duct 3 to recover the sensible heat of the hot exhaust gas discharged from the furnace and to efficiently utilize the recovered sensible heat as the energy for pre-heating oxygen-containing gas C blown through the secondary combustion burners 6, generating electricity for the arc, drying pellets B, etc.

The electrodes 5 are preferably of, for example, a three-phase alternating current type that is excellent in terms of heat efficiency and commonly used in steel-making electric arc furnaces. For example, a configuration of six electrodes is preferably employed, which consists of three pairs of each single phase constituted by a three-phase electrode.

Tip portions of the electrodes 5 are preferably positioned (submerged) in the metal agglomerate raw material layer 13 or a molten slag layer 15 while conducting the melting operation. As a result, the melting can be accelerated by the effects of radiant heat and resistance heat by arcs, and the damage on the inner surface of furnace walls which are not protected with the raw material layer 12 described below can be suppressed.

Hereinafter, as an example, the case in which this stationary non-tilting arc furnace is used to manufacture molten iron as molten metal will be described. In this example, coal only is used as the raw material for forming the raw material layer in the furnace, and carbon composite iron oxide pellets as the metal oxide agglomerates with carbonaceous material are stacked only as the metal agglomerate raw material on the raw material layer.

In a method for manufacturing molten metal, a particular amount of coal A is charged as the raw material for forming the raw material layer from the raw material charging chutes 4 installed in both ends 2 of the furnace in the width direction. In the example, the coal A forms a raw material layer 12 having a sloping surface 12*a* extending downward from both ends 2 of the furnace in the width direction toward "the lower end portions of the electrodes 5", which is an electric heating region heated with the electrodes 5 serving as electric heating means. The size distribution of the coal A is preferably adjusted according to the size of carbon composite iron oxide pellets B described below so that the carbon composite iron oxide pellets B do not penetrate into gaps in the raw material layer 12.

Next, carbon composite iron oxide pellets (also simply referred to as "pellets" hereinafter) B only as the metal oxide agglomerates with carbonaceous material serving as the metal agglomerate raw material are continuously or intermittently charged from the raw material charging chutes 4 installed in both ends 2 of the furnace in the width direction so as to form a pellet layer 13 as a metal agglomerate raw material layer on the sloping surface 12*a* of the raw material layer 12. The amount of the carbonaceous material contained in the pellets B may be determined on the basis of the theoretically required C amount for reducing iron oxide to metallic iron, and the target C concentration of molten iron. The pellets B are preferably dried in advance so that they do not burst when charged into the furnace.

As described above, the heights of the electrodes 5 are preferably adjusted in advance so that the lower end portions thereof are submerged in the pellet layer 13.

As electricity is then supplied to the electrodes to conduct arc heating, the pellets B near the lower end portion of the pellet layer 13 become sequentially reduced, melted, and separate into molten iron as molten metal and molten slag by being rapidly heated, i.e., form a molten iron layer 14 and a molten slag layer 15 on the furnace bottom. Preferably, a CaO source or a MgO source such as limestone or dolomite is mixed into the pellets B in advance to adjust the basicity or the like of the molten slag layer 15.

As the pellets B sequentially melt from near the lower end portion of the pellet layer 13 as described above, the pellet layer 13 starts to sequentially descend in the furnace by gravity toward the lower end portions of the electrodes 5 along the sloping surface of the raw material layer 12. Even if some of the pellets B in the pellet layer 13 penetrate into gaps in the raw material layer 12, such pellets B will be thermally reduced or heated and eventually fused or melted since they stay in the furnace for a long time and will not cause any problem since they separate into molten iron and molten slag and drop onto the molten iron layer 14 and the molten slag layer 15 on the furnace bottom through gaps in the raw material layer 12.

As the pellets B in the pellet layer 13 approach the electrodes 5, the pellets B are efficiently heated by radiant heat and resistance heat generated by arcs from the electrodes 5, the iron oxide inside the pellets B is pre-reduced to solid metallic iron by the carbonaceous material contained in the pellets B, and CO-containing gas (combustible gas) is generated. When a carbonaceous material, such as coal, having a volatile component is used as the carbonaceous material to be contained in the pellets, the volatile component evaporated from this carbonaceous material by heating is also added to the CO-containing gas.

Combustion (secondary combustion) of the CO-containing gas is accelerated by oxygen-containing gas C, e.g., oxygen gas, horizontally blown from the secondary combustion burners 6 installed in the rising portions 1*a* of the stepped structure of the sloping furnace top 1'. The radiant heat generated by the combustion (secondary combustion) also heats the pellet layer 13. As the pellet layer 13 is thus heated by radiant heat, iron oxide in the pellets B is pre-reduced to solid metallic iron and CO-containing gas is generated as in the case of radiant heating and resistance heating with arcs from the electrodes 5; thus, radiant heating by the secondary combustion is further accelerated.

As described above, the pellets B charged into the furnace from the raw material charging chutes 4 are pre-reduced in a solid state by radiant heating caused by the secondary combustion (hereafter, also referred to as "secondary combustion heat") as they descend on the sloping surface 12*a* of the raw material layer 12 until the metallization becomes higher, then they are melted by arc heat and resistance heat near the lower end portions of the electrodes 5, and are separated into molten iron and molten slag.

Accordingly, the iron oxide concentration in the molten slag generated near the lower end portions of the electrodes 5 becomes sufficiently low and wear of the electrodes 5 can be suppressed.

The carbonaceous material remaining in the pellets B is dissolved into the molten iron separated from molten slag, to thereby form molten iron having a target C concentration.

The molten iron and molten slag manufactured as such can be intermittently discharged from the tap hole 7 and the slag tap hole 8 in the furnace bottom in the same manner as tapping methods for blast furnaces, for example.

On the other hand, the raw material layer 12 formed by charging the coal A in the furnace at the initial stage is gradually heated in the furnace to have the volatile component therein removed, and turns into char or coke. The volatile component removed is burned with oxygen-containing gas blown from the secondary combustion burners 6 along with the CO-containing gas generated from the pellet layer 13 and efficiently used as the energy for radiantly heating the pellet layer 13. As described above, since carbon in the carbonaceous material contained in the pellets B is balanced for the reduction of iron oxide in the pellets and carburization of molten iron, the charred or coked layer as the raw material layer 12 theoretically remains unconsumed. However, in actual operation, the raw material layer 12 is gradually consumed in the course of a long-term operation by direct reduction reactions with the pellets B penetrating into the raw material layer 12, and by the carburization reaction for molten iron. The amount the raw material layer 12 in the furnace can be maintained by the following operation every once in a particular operation period: continue arc heating operation at least for a predetermined period of time while stopping the feed of pellets B from the raw material charging chutes 4 so as to substantially melt the pellet layer 13 in the furnace and to expose the sloping surface 12*a* of the raw material layer 12. Then a predetermined amount of coal (carbonaceous material) A is charged from the raw material charging chutes 4 while discontinuing the arc heating and secondary combustion.

Since the inner faces of the two side walls in the furnace width direction are covered with the raw material layer 12, the wear of the refractories in such portions is significantly suppressed. Accordingly, high-quality refractories having superb corrosion resistance and water-cooling structures are only needed for the two side walls in the furnace longitudinal direction that are not covered with the raw material layer 12, thus achieving significant facility cost reduction.

Figure 2B:
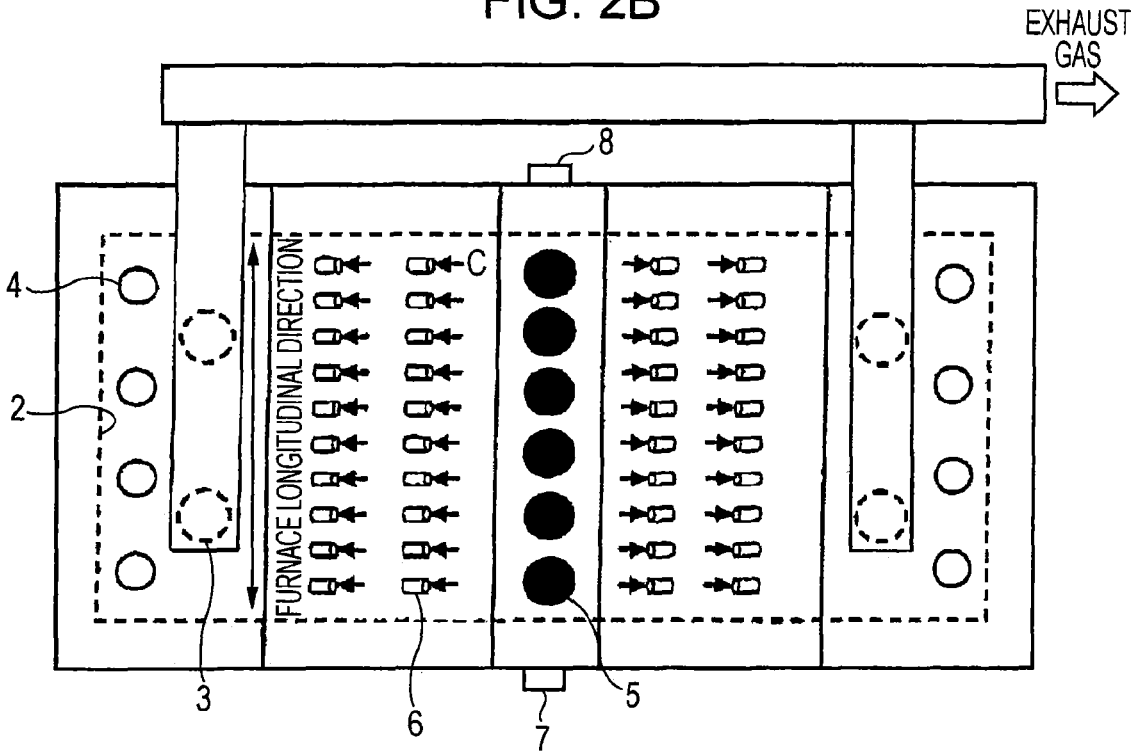
FIG. 2B is a plan view illustrating an outline configuration of an apparatus for manufacturing molten metal according to another embodiment of the present invention.

In the aforementioned embodiment, an example in which the sloping portion (sloping furnace top) 1' that generally slopes downward in the furnace top 1 is formed so as to have a stepped structure is described. However, the present invention is not limited to the example. For example, as illustrated in FIGS. 2A and 2B, the sloping furnace top 1' may be formed so as to have a slanting-surface structure. In this case, as illustrated in FIG. 2A, the secondary combustion burners 6 may be perpendicularly disposed in portions of a downward slanting surface 1*d* of the furnace top 1 so that oxygen-containing gas C blown can be made to flow away from the electrodes 5. However, in view of accelerating the secondary combustion, as described in the embodiment, the stepped structure easily makes the gas flows turbulent to accelerate mixing of the gases and increases the secondary combustion efficiency. In this modification, the sloping angle of the portion that generally slopes downward in the furnace top 1 is defined as the sloping angle of the downward slanting surface 1*d*.

As for the arrangement of the raw material charging chutes 4 and the electrodes 5 in the aforementioned embodiment, an example in which the raw material charging chutes 4 are installed in both ends 2 of the furnace in the width direction and the electrodes 5 are installed in the center position of the furnace top 1 in the furnace width direction is described; alternatively, a modification in which the raw material charging chutes 4 are installed in one end 2 of the furnace in the width direction and the electrodes 5 are installed in the other end 2 of the furnace in the width direction may be employed. When this modification is employed, the slope of the raw material layer 12 that is formed in the furnace is provided on one side only. This is a disadvantage from the viewpoint of refractory protection compared to the aforementioned embodiment; however, there are also advantages in that the furnace width can be reduced and thus the facility can be made more compact.

In the aforementioned embodiment, an example in which the electrodes 5 are installed on the center line of the furnace in the width direction is described as an example in which the electrodes 5 are installed in the center position of the furnace in the width direction. However, the electrodes 5 are not necessarily installed accurately on the center line of the furnace in the width direction and may be installed at positions close to ends of the furnace in the width direction with respect to the center line of the furnace in the width direction.

In the aforementioned embodiment, an example in which the exhaust gas duct 3 and the raw material charging chutes 4 are connected to the furnace top 1 is described. However, the arrangement is not limited to this and one or both of the exhaust gas duct 3 and the raw material charging chutes 4 may be connected to upper portions of the furnace side walls. In the case where the raw material charging chutes 4 are connected to the upper portions of the furnace side walls, the raw material charging chutes 4 are automatically installed in ends of the furnace in the width direction.

In the aforementioned embodiment, an example in which the stationary non-tilting arc furnace has a predominately rectangular shape in a horizontal cross-section is described, but the shape is not limited to this. For example, a furnace having a round or predominately elliptical cross-section may be used. In such a case, three electrodes may be employed for a three-phase power supply instead of the 3 pairs of single-phase electrodes. However, when the furnace with a predominately rectangular cross-section is used, there is an advantage that the scale of the furnace can be easily increased by extending the furnace in the longitudinal direction (the direction perpendicular to the furnace width direction) without changing the furnace width.

In the aforementioned embodiment, an example of using an arc furnace as a stationary non-tilting electric furnace is described; however, the furnace is not limited to this and any furnace that conducts heating with electrical energy, such as a submerged arc furnace, an electromagnetic induction heating furnace, or the like, can be employed. In the submerged arc furnace, electrodes can be used as the electric heating means as in the aforementioned embodiment. In the electromagnetic induction heating furnace, solenoid heating coils can be used as the electric heating means.

Although pellets are used as an example of the metal oxide agglomerates with carbonaceous material B in the aforementioned embodiment, briquettes may be employed. Since briquettes have a greater angle of repose than spherical pellets, the furnace height must be increased in order to secure the residence time on the sloping surface 12*a* of the raw material layer 12 compared to the case of using pellets, but there is an advantage that the furnace width can be reduced.

In the aforementioned embodiment, an example in which the metal oxide agglomerates with carbonaceous material B (carbon composite iron oxide pellets) only are used as the metal agglomerate raw material is described, but this example is not limiting. Alternatively, the metal agglomerate raw material may be, instead of the metal oxide agglomerates with carbonaceous material B, metal scrap (iron scrap), reduced metal (reduced iron [DRI or HBI]), metal oxide agglomerate ore (agglomerate iron ore), metal chloride agglomerates with carbonaceous material that contain a metal chloride, or metal oxide ore agglomerates (baked iron oxide pellets, cold bonded iron oxide pellets, or iron oxide sintered ore). Alternatively, the metal agglomerate raw material may be one or more selected from the group consisting of metal oxide agglomerates with carbonaceous material (carbon composite iron oxide pellets and carbon composite iron oxide briquettes), metal scrap, reduced metal, metal oxide agglomerate ore, metal chloride agglomerates with carbonaceous material, and metal oxide ore agglomerates.

In the aforementioned embodiment, an example in which only iron, i.e., a nonvolatile metal element, is contained in the metal oxide agglomerates with carbonaceous material B is described. Alternatively, in addition to the nonvolatile metal element, volatile metal elements, e.g., Zn, Pb, and the like, may be contained. In other words, steel mill dust containing volatile metal elements can be used as the metal oxide raw material in the metal oxide agglomerates with carbonaceous material B. Volatile metal elements evaporate from the metal oxide agglomerates with carbonaceous material B by being heated in the furnace. According to a method of the present invention, the temperature in the furnace top can be maintained sufficiently high with combustion heat generated with the secondary combustion burners 6. Thus, re-condensation of the volatile metal elements evaporated can be assuredly prevented in the furnace top and the volatile metal elements can be efficiently recovered from the exhaust gas discharged from the furnace.

In this specification, a "volatile metal element" refers to a metal element in an elemental form or a compound form such as a salt, having a melting point of 1100° C. or less at 1 atm. Examples of the elemental metal include zinc and lead. Examples of the compound of the volatile metal element include sodium chloride and potassium chloride. The volatile metals in the compounds are reduced to metals in an electric furnace (e.g., an arc furnace or a submerged arc furnace) and part or all of the volatile metals are present in a gas state in the furnace. The chlorides of volatile metal elements are heated in the electric furnace and part or all of the chlorides are present in a gas state in the furnace. In contrast, a "nonvolatile metal element" refers to a metal element in an elemental form or a compound form such as an oxide, having a melting point of more than 1100° C. at 1 atm. Examples of the elemental metal include iron, nickel, cobalt, chromium, and titanium. Examples of the oxides of the nonvolatile metals include CaO, SiO2, and Al2O3. When an arc furnace or a submerged arc furnace is used as the electric furnace, the compounds of the nonvolatile metal elements can exist in a gas state near the arcs in the furnace (arc temperature region) by taking form of reduced elemental metals or unreduced compounds due to heating or reduction reactions in the furnace, but exist in a liquid or solid state in a region remote from the arcs.

Although only iron (Fe) is used as an example of the metal element constituting the metal oxide agglomerates with carbonaceous material B as the metal agglomerate raw material and the molten metal layer 14 in the aforementioned embodiment, nonferrous metals such as Ni, Mn, Cr, and the like may be contained in addition to Fe.

In the aforementioned embodiment, adding the CaO source or MgO source to the metal oxide agglomerates with carbonaceous material B in advance is described as an example of the means for adjusting the basicity of the molten slag. Instead of or in addition to such means, limestone or dolomite may be charged from the raw material charging chutes 4 together with the metal oxide agglomerates with carbonaceous material B, or limestone or dolomite may be charged from chutes that are separate from the raw material charging chutes 4 for the metal oxide agglomerates with carbonaceous material B.

Although coal is described as an example of a carbonaceous material constituting the raw material layer 12 in the aforementioned embodiment, coke may be used. Since coke is already devolatilized and does not generate volatile components in the furnace, coke is less likely to burst than coal although contribution to the secondary combustion is reduced. Thus, there is an advantage in that the scattering loss can be reduced.

The metal agglomerate raw material may be used for forming the raw material layer 12 in addition to or instead of the carbonaceous material such as coal or coke. When the metal agglomerate raw material is used as the raw material for forming the raw material layer 12, although reduction and melting or carburization and dissolution occurs in the portion that comes in contact with the molten iron, heat does not readily conduct to portions far from the portion contacting the molten iron, and the metal agglomerate raw material remains in a solid state. Thus, the raw material layer 12 once formed remains in a layer state for a long time. Moreover, since the temperature in the raw material layer 12 decreases as the distance from the region contacting the molten iron increases and the distance to the furnace wall decreases, damage on the refractory caused by formation of molten FeO does not pose a problem.

In the aforementioned embodiment, an example in which the tap hole 7 and the slag tap hole 8 are formed in different side walls opposing each other is described. However, the tap hole 7 and the slag tap hole 8 may be installed in the same side wall or the slag tap hole 8 may be omitted and only the tap hole 7 may be formed so that the molten iron and the molten slag can be discharged through the tap hole 7.

Hereinafter, another embodiment of the present invention will be described in detail with reference to drawings.

Figure 3A:
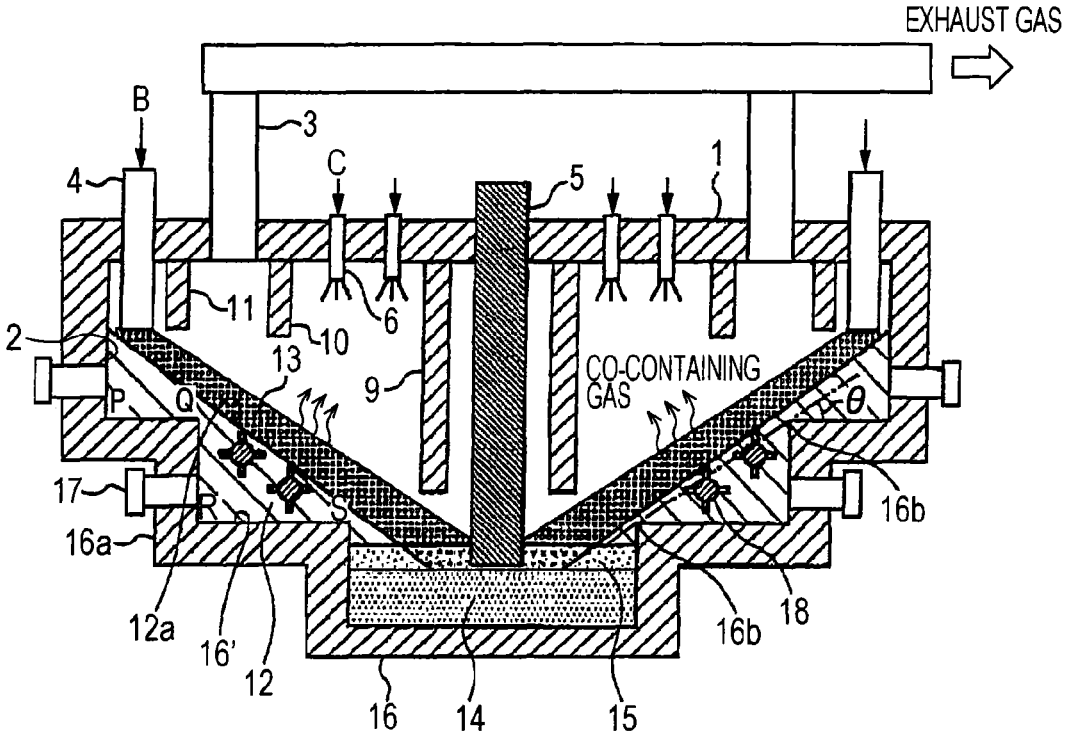
FIG. 3A is a cross-sectional view in the width direction, illustrating an outline configuration of an apparatus for manufacturing molten metal according to an embodiment of the present invention.
Figure 3B:
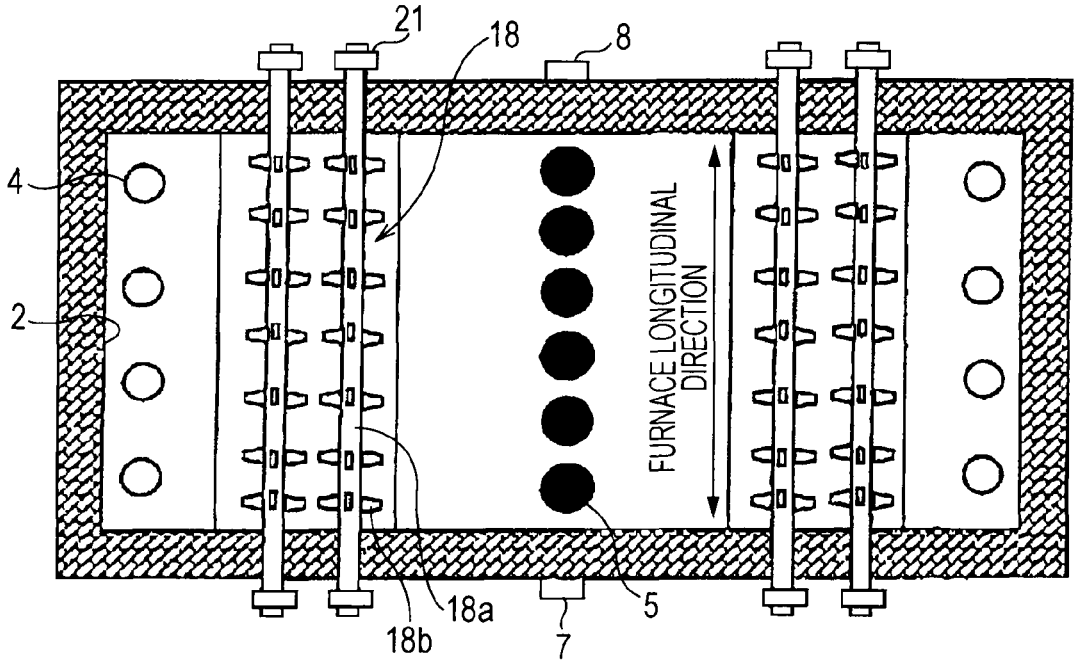
FIG. 3B is a partial horizontal-sectional view illustrating an outline configuration of an apparatus for manufacturing molten metal according to an embodiment of the present invention.

FIGS. 3A and 3B illustrate an outline configuration of an apparatus for manufacturing molten metal according to an embodiment of the present invention. A stationary non-tilting electric furnace (also simply referred to as "furnace" hereinafter) of the embodiment is an arc furnace having a predominately rectangular shape in a horizontal cross-section. An exhaust gas duct 3 and raw material charging chutes 4 are connected to the furnace top (furnace top 1 in the embodiment). Electrodes 5 that function as electric heating means (heaters) are inserted through the furnace top 1 into the furnace. The raw material charging chutes 4 are provided in both ends 2 of the furnace in the width direction while the electrodes 5 are provided in the center position of the furnace in the width direction. Secondary combustion burners 6 are provided in the furnace top (furnace top 1 in the embodiment).

A furnace bottom 16 has a sloping portion (sloping furnace bottom) 16' that generally slopes downward from both ends 2 of the furnace in the width direction to the center position of the furnace in the width direction (that is, the position of the electrodes 5). In the embodiment, a furnace that has a sloping furnace bottom 16' having a stepped structure (zigzag line formed by connecting points P, Q, R, and S in the embodiment) will be described.

Access holes 17 are preferably provided in, for example, rising portions 16*a* of the stepped structure.

As described above, the furnace bottom 16 is formed so as to have the sloping portion (sloping furnace bottom) 16' that generally slopes downward from the ends of the furnace in the width direction to the center position of the furnace in the width direction where the electrodes 5 serving as electric heating means are present. As a result, the distance between the sloping furnace bottom 16' and the metal agglomerate raw material layer 13 can be shortened. Accordingly, even when hanging of the metal agglomerate raw material layer 13 is caused, although the furnace operation needs to be temporarily terminated for safety, the hanging of the metal agglomerate raw material layer 13 can be readily and reliably overcome in the following manner: the access holes 17 provided in the rising portions 16*a* of the stepped structure are opened, mechanical units such as breakers are inserted through the openings and used to apply a physical external force.

To make the operation of overcoming the hanging of the metal agglomerate raw material layer 13 as easy as possible, the distance between the sloping furnace bottom 16' and the metal agglomerate raw material layer 13 is preferably minimized. To achieve this, the sloping angle of the sloping furnace bottom 16' is preferably made as close as possible to the sloping angle of the surface of the metal agglomerate raw material layer 13. Since the sloping angle of the surface of the metal agglomerate raw material layer 13 is an angle between the collapse angle and the static angle of repose of metal agglomerate raw material B, the sloping angle of the sloping furnace bottom 16' is preferably in the range of [the collapse angle of metal agglomerate raw material B−25° (more preferably the collapse angle−20°, still more preferably the collapse angle−15°)] or more and [the static angle of repose of metal agglomerate raw material B+5° (more preferably the static angle of repose, still more preferably the collapse angle)] or less. The sloping angle of the sloping furnace bottom 16' is defined as the sloping angle (θ in FIG. 3A) of a line connecting edges (16*b* in FIG. 3A), within the furnace, of the steps of the stepped structure.

A shock generator 18 that mechanically overcomes hanging of the metal agglomerate raw material layer 13 is preferably disposed, within the furnace, between the sloping furnace bottom 16' and the surface of the metal agglomerate raw material layer 13. The "shock generator" is a device that continuously or intermittently applies an external force to the metal agglomerate raw material layer 13.

The shock generator 18 may be constituted by, for example, a shaft 18*a* having a rotational axis lying in the furnace longitudinal direction and disintegrating members 18*b* protruding from the surface of the shaft 18*a* (the shock generator 18 may be similar to a burden feeder that is disposed within a shaft furnace for Midrex direct reduction process and is used to prevent hanging of reduced iron). By rotating the shaft 18*a* of the shock generator 18 continuously or intermittently at regular intervals, hanging of the metal agglomerate raw material layer 13 can be suppressed. Even if hanging of the metal agglomerate raw material layer 13 occurs, sintered or fused metal agglomerate raw material B can be disintegrated with the disintegrating members 18*b* protruding from the shaft 18*a*; even when the sintered or fused material is not sufficiently disintegrated, the metal agglomerate raw material layer 13 can be forcedly transported downward (lowered) toward the lower portions of the electrodes 5 before the sintered or fused material becomes coarse; accordingly, the operation can be smoothly performed for a long period of time.

To effectively provide such a function in response to the occurrence of hanging, the shock generator 18 that is similar to the burden feeder may be properly selected from a shock generator that rotates about its rotational axis in one direction (normal direction) only in which the metal agglomerate raw material layer 13 descends and a shock generator that alternately rotates about its rotational axis in the direction (normal direction) in which the metal agglomerate raw material layer 13 descends and in the opposite direction. The former shock generator is intended to perform transportation, whereas the latter shock generator is intended to perform disintegration.

Partition walls 9, 10, and 11 that are suspended in the furnace are preferably provided between the electrodes 5 and the secondary combustion burners 6, between the secondary combustion burners 6 and the exhaust gas duct 3, and between the exhaust gas duct 3 and the raw material charging chutes 4.

It is preferable to provide the partition walls 9 between the electrodes 5 and the secondary combustion burners 6 to prevent the oxidizing exhaust gas after secondary combustion from contacting the electrodes 5.

It is preferable to provide the partition walls 10 between the secondary combustion burners 6 and the exhaust gas duct 3 to prevent the exhaust gas after secondary combustion from short-cutting to the exhaust gas duct 3 and to transfer a sufficient amount of radiant heat to the metal agglomerate raw material layer 13.

It is preferable to provide the partition walls 11 between the exhaust gas duct 3 and the raw material charging chutes 4 to prevent damage on the raw material charging chutes 4 caused by overheating with hot exhaust gas.

All or some of the partition walls 9, 10, and 11 may be installed by comprehensively considering the effects of partition installation, installation costs, maintenance work, etc.

The exhaust gas duct 3 is preferably provided closer to the raw material charging chutes 4 than to the electrodes 5. This is to suppress oxidizing exhaust gas after secondary combustion from flowing toward the electrodes 5 and to thereby suppress damage on the electrodes 5.

In the furnace bottom, a tap hole 7 and a slag tap hole 8 are preferably provided in furnace side walls in the furnace longitudinal direction where the raw material charging chutes 4 are not provided (i.e., where raw material layers 12 are not provided in the furnace). This is to facilitate the hole-opening operation during the tapping of molten metal and the slag.

Common heat-exchangers (not shown) may be installed downstream of the exhaust gas duct 3 to recover the sensible heat of the hot exhaust gas discharged from the furnace and to efficiently utilize the recovered sensible heat as the energy for generating electricity for the arc, for drying pellets B, etc.

The electrodes 5 are preferably of a three-phase alternating current type that is excellent in terms of heat efficiency and commonly used in steel-making electric arc furnaces. For example, a configuration of six electrodes is preferably employed, which consists of three pairs of each single phase constituted by a three-phase electrode.

Tip portions of the electrodes 5 are preferably positioned (submerged) in the metal agglomerate raw material layer 13 or a molten slag layer 15 while conducting the melting operation. As a result, the melting can be accelerated by the effects of radiant heat and resistance heat by arcs, and the damage on the inner surface of furnace walls which are not protected with the raw material layer 12 can be suppressed.

Hereinafter, as an example, the case in which this stationary non-tilting arc furnace is used to manufacture molten iron as molten metal will be described. In this example, carbon composite iron oxide pellets are used as the raw material for forming the raw material layer in the furnace, and the carbon composite iron oxide pellets are also stacked as the metal agglomerate raw material on the raw material layer.

In a method for manufacturing molten metal, a particular amount of carbon composite iron oxide pellets A' are charged as the raw material for forming the raw material layer from the raw material charging chutes 4 installed in both ends 2 of the furnace in the width direction. The carbon composite iron oxide pellets A' form the raw material layer 12 having a sloping surface 12*a* extending downward from both ends 2 of the furnace in the width direction toward the lower end portions of the electrodes 5. When the metal agglomerate raw material such as the carbon composite iron oxide pellets A' is used for forming the raw material layer 12 instead of the carbonaceous material A, reduction and melting or carburization and dissolution occurs in the portion that comes in contact with the molten iron. However, heat does not readily conduct to portions far from the portion contacting the molten iron, and the metal agglomerate raw material remains in a solid state. Thus, the raw material layer 12 once formed remains in a layer state for a long time. Moreover, since the temperature in the raw material layer 12 decreases as the distance from the region contacting the molten iron increases and the distance to the furnace wall decreases, damage on the refractory caused by formation of molten FeO does not pose a problem.

Next, carbon composite iron oxide pellets (also simply referred to as "pellets" hereinafter) B as the metal oxide agglomerates with carbonaceous material serving as the metal agglomerate raw material are continuously or intermittently charged from the raw material charging chutes 4 installed in both ends 2 of the furnace in the width direction so as to form a pellet layer 13 as a metal agglomerate raw material layer on the sloping surface 12*a* of the raw material layer 12. The amount of the carbonaceous material contained in the pellets B may be determined on the basis of the theoretically required carbon amount for reducing iron oxide to metallic iron, and the target carbon concentration of molten iron. The pellets B are preferably dried in advance so that they do not burst when charged into the furnace.

As described above, the heights of the electrodes 5 are preferably adjusted in advance so that the lower end portions thereof are submerged in the pellet layer 13.

As electricity is then supplied to the electrodes to conduct arc heating, the pellets B near the lower end portion of the pellet layer 13 become sequentially reduced, melted, and separate into molten iron as molten metal and molten slag by being rapidly heated, i.e., form a molten iron layer 14 and a molten slag layer 15 on the furnace bottom. Preferably, a CaO source or a MgO source such as limestone or dolomite is mixed into the pellets B in advance to adjust the basicity or the like of the molten slag layer 15.

The pellets B sequentially melt from near the lower end portion of the pellet layer 13 as described above, the pellet layer 13 starts to sequentially descend in the furnace by gravity toward the lower end portions of the electrodes 5 along the sloping surface of the raw material layer.

As the pellets B in the pellet layer 13 approach the electrodes 5, the pellets B are efficiently heated by radiant heat and resistance heat generated by arcs from the electrodes 5, the iron oxide inside the pellets B is pre-reduced to solid metallic iron by the carbonaceous material contained in the pellets B, and CO-containing gas (combustible gas) is generated. When a carbonaceous material, such as coal, having a volatile component is used, the volatile component evaporated from this carbonaceous material by heating is also added to the CO-containing gas.

The CO-containing gas is burned (secondary combustion) by oxygen-containing gas, e.g., oxygen gas, blown from the secondary combustion burners 6 installed in the furnace top 1. The radiant heat generated by the combustion (secondary combustion) also heats the pellet layer 13. As the pellet layer 13 is thus heated by radiant heat, iron oxide in the pellets is pre-reduced to solid metallic iron and CO-containing gas is generated as in the case of radiant heating and resistance heating with arcs from the electrodes 5; thus, radiant heating by the secondary combustion is further accelerated.

As described above, the pellets B charged into the furnace from the raw material charging chutes 4 are pre-reduced in a solid state by radiant heating caused by the secondary combustion (hereafter, also referred to as "secondary combustion heat") as they descend on the sloping surface 12*a* of the raw material layer 12 until the metallization becomes higher, then they are melted by arc heat and resistance heat near the lower end portions of the electrodes 5, and are separated into molten iron and molten slag.

Accordingly, the iron oxide concentration in the molten slag generated near the lower end portions of the electrodes 5 becomes sufficiently low and wear of the electrodes 5 can be suppressed.

The carbonaceous material remaining in the pellets B is dissolved into the molten iron separated from molten slag, to thereby form molten iron having a target carbon concentration.

The molten iron and molten slag manufactured as such can be intermittently discharged from the tap hole 7 and the slag tap hole 8 in the furnace bottom in the same manner as tapping methods for blast furnaces, for example.

In the aforementioned embodiment, an example in which the sloping furnace bottom 16' is formed so as to have a stepped structure is described. However, the present invention is not limited to the example. The sloping furnace bottom 16' may be formed so as to have a slanting-surface structure.

In the aforementioned embodiment, an example in which each of the shock generators 18 similar to burden feeders is disposed across the furnace in the longitudinal direction is described. However, the shock generators 18 similar to burden feeders have a structural limitation on the length of the shaft 18*a* because they may deform due to their own weight or the load of charged materials. Accordingly, the length of the furnace is limited by the length of the shaft 18*a* of the shock generators 18 and hence an increase in the length of the furnace in the longitudinal direction is limited. To overcome such a problem, the following configuration is preferably employed.

Figure 4A:
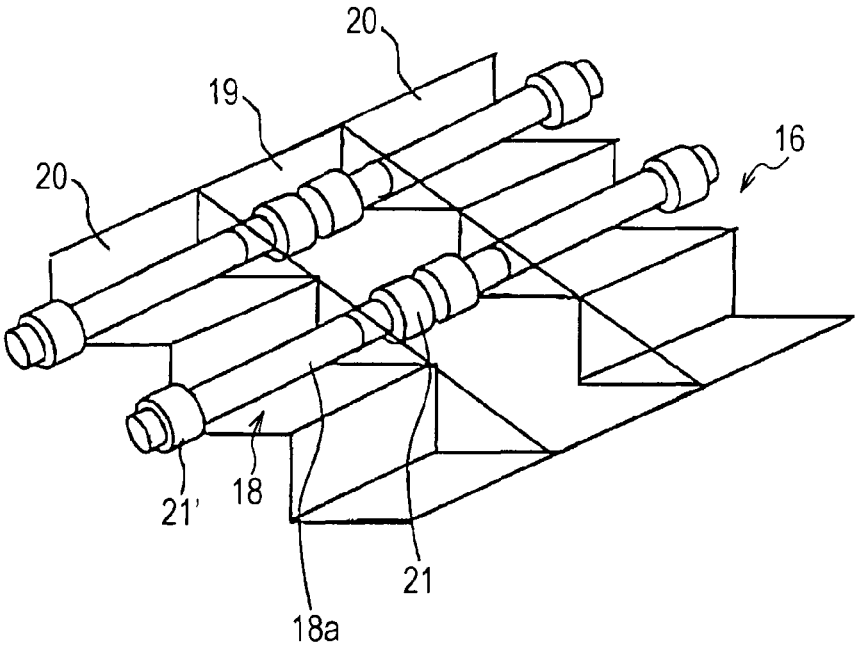
FIG. 4A is a fragmentary perspective view illustrating an outline configuration of an apparatus for manufacturing molten metal according to another embodiment of the present invention.
Figure 4B:
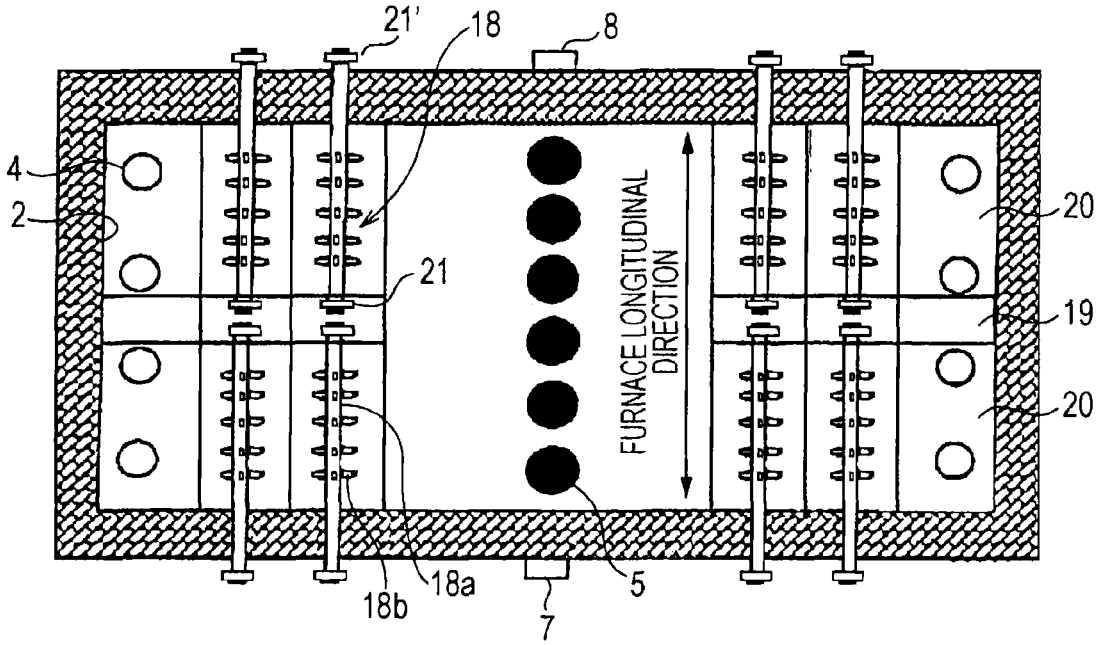
FIG. 4B is a plan view illustrating an outline configuration of an apparatus for manufacturing molten metal according to another embodiment of the present invention.

As illustrated in FIGS. 4A and 4B, the sloping furnace bottom 16' is formed so as to have a slanting-surface portion 19 and a stepped portion 20 that are alternately located in the furnace in the longitudinal direction (to make the configuration more readily understandable, the slanting-surface portion 19 is drawn as a translucent portion in FIG. 4A). The shock generators 18 (two shock generators 18 in this example) similar to burden feeders are disposed in series, within the furnace, between the sloping furnace bottom 16 and the surface of the metal agglomerate raw material layer 13 such that the rotational axes of the shock generators 18 lie in the furnace longitudinal direction. As described above, the shock generators 18 are constituted by a shaft 18*a* having a rotational axis lying in the furnace longitudinal direction and disintegrating members 18*b* protruding from the surface of the shaft 18*a* (the disintegrating members 18*b* are not shown in FIG. 4A). Bearings 21 that support at least one ends (one ends in this example) of the shafts 18*a* of the shock generators 18 are disposed, outside the furnace, below the slanting-surface portion 19 of the sloping furnace bottom 16' (in this example, as illustrated in FIG. 4B, bearings 21' that support the other ends of the shafts 18*a* are disposed, outside the furnace, beyond the side walls). The portions of the shafts 18*a* from which the disintegrating members 18*b* are protruded in the shock generators 18 are disposed, inside the furnace, above the stepped portions 20 of the sloping furnace bottom 16.

When the aforementioned configuration is employed, any number of the shock generators 18 similar to burden feeders can be disposed in series in the furnace longitudinal direction. Accordingly, while hanging of the metal agglomerate raw material layer 13 is effectively overcome (or prevented), an increase in the length of the furnace in the longitudinal direction can be readily achieved.

In the aforementioned embodiment, a device (constituted by the shaft 18*a* and disintegrating members 18*b* protruding from the surface of the shaft 18*a*) that applies an external force to the metal agglomerate raw material layer 13 by rotation about the rotational axis and is similar to a burden feeder is described as an example of the shock generators 18. However, the shock generators 18 are not limited to the device and any device that can continuously or intermittently apply an external force to the metal agglomerate raw material layer 13 may be used. For example, a screw device may be used as another device that applies an external force by rotation about the rotational axis. Alternatively, a pusher device may be used as a device that applies an external force by reciprocation of a cylinder or the like. Alternatively, a device that applies an external force by gas pressure may be used such as a device that directly blows gas into the furnace or a device that deforms a diaphragm by gas pressure.

As for the arrangement of the raw material charging chutes 4 and the electrodes 5 in the aforementioned embodiment, an example in which the raw material charging chutes 4 are installed in both ends 2 of the furnace in the width direction and the electrodes 5 are installed in the center position of the furnace top 1 in the furnace width direction is described; alternatively, a modification in which the raw material charging chutes 4 are installed in one end 2 of the furnace in the width direction and the electrodes 5 are installed in the other end 2 of the furnace in the width direction may be employed. When this modification is employed, the slope of the raw material layer 12 that is formed in the furnace is provided on one side only. This is a disadvantage from the viewpoint of refractory protection compared to the aforementioned embodiment; however, there are also advantages in that the furnace width can be reduced and thus the facility can be made more compact. In the aforementioned embodiment, an example in which the electrodes 5 are installed on the center line of the furnace in the width direction is described as an example in which the electrodes 5 are installed in the center position of the furnace in the width direction. However, the electrodes 5 are not necessarily installed accurately on the center line of the furnace in the width direction and may be installed at positions closer to ends of the furnace in the width direction with respect to the center line of the furnace in the width direction.

In the aforementioned embodiment, an example in which the exhaust gas duct 3 and the raw material charging chutes 4 are connected to the furnace top 1 is described. However, the arrangement is not limited to this and one or both of the exhaust gas duct 3 and the raw material charging chutes 4 may be connected to upper portions of the furnace side walls. In the case where the raw material charging chutes 4 are connected to the upper portions of the furnace side walls, the raw material charging chutes 4 are automatically installed in ends of the furnace in the width direction.

In the aforementioned embodiment, an example in which the stationary non-tilting arc furnace has a predominately rectangular shape in a horizontal cross-section is described, but the shape is not limited to this. For example, a furnace having a round or predominately elliptical cross-section may be used. In such a case, three electrodes may be employed for a three-phase power supply instead of the 3 pairs of single-phase electrodes. However, when the furnace with a predominately rectangular cross-section is used, there is an advantage that the scale of the furnace can be easily increased by extending the furnace in the longitudinal direction (the direction perpendicular to the furnace width direction) without changing the furnace width.

Although pellets are used as an example of the metal oxide agglomerates with carbonaceous material B in the aforementioned embodiment, briquettes may be employed. Since briquettes have a greater angle of repose than spherical pellets, the furnace height must be increased in order to secure the residence time on the sloping surface 12*a* of the raw material layer 12 compared to the case of using pellets, but there is an advantage that the furnace width can be reduced.

In the aforementioned embodiment, an example in which the metal oxide agglomerates with carbonaceous material (carbon composite iron oxide pellets) only are used as the metal agglomerate raw material is described. Alternatively, the metal agglomerate raw material may be, instead of the metal oxide agglomerates with carbonaceous material (carbon composite iron oxide pellets and carbon composite iron oxide briquettes), metal scrap (iron scrap), reduced metal (reduced iron [DRI or HBI]), metal oxide agglomerate ore (agglomerate iron ore), metal chloride agglomerates with carbonaceous material that contain a metal chloride, or metal oxide ore agglomerates (baked iron oxide pellets, cold bonded iron oxide pellets, or iron oxide sintered ore). Alternatively, the metal agglomerate raw material may be one or more selected from the group consisting of metal oxide agglomerates with carbonaceous material, metal scrap, reduced metal, metal oxide agglomerate ore, metal chloride agglomerates with carbonaceous material, and metal oxide ore agglomerates.

In the aforementioned embodiment, an example in which only iron, i.e., a nonvolatile metal element, is contained in the metal oxide agglomerates with carbonaceous material B is described. Alternatively, in addition to the nonvolatile metal element, volatile metal elements, e.g., Zn, Pb, and the like, may be contained. In other words, steel mill dust containing volatile metal elements can be used as the metal oxide raw material in the metal oxide agglomerates with carbonaceous material B. Volatile metal elements evaporate from the metal oxide agglomerates with carbonaceous material B by being heated in the furnace. According to a method of the present invention, the temperature in the furnace top can be maintained sufficiently high with combustion heat generated with the secondary combustion burners 6. Thus, re-condensation of the volatile metal elements evaporated can be assuredly prevented in the furnace top and the volatile metal elements can be efficiently recovered from the exhaust gas discharged from the furnace.

In this specification, a "volatile metal element" refers to a metal element in an elemental form or a compound form such as a salt, having a melting point of 1100° C. or less at 1 atm. Examples of the elemental metal include zinc and lead. Examples of the compound of the volatile metal element include sodium chloride and potassium chloride. The volatile metals in the compounds are reduced to metals in an electric furnace (e.g., an arc furnace or a submerged arc furnace) and part or all of the volatile metals are present in a gas state in the furnace. The chlorides of volatile metal elements are heated in the electric furnace and part or all of the chlorides are present in a gas state in the furnace. In contrast, a "nonvolatile metal element" refers to a metal element in an elemental form or a compound form such as an oxide, having a melting point of more than 1100° C. at 1 atm. Examples of the elemental metal include iron, nickel, cobalt, chromium, and titanium. Examples of the oxides of the nonvolatile metals include CaO, SiO2, and Al2O3. When an arc furnace or a submerged arc furnace is used as the electric furnace, the compounds of the nonvolatile metal elements can exist in a gas state near the arcs in the furnace (arc temperature region) by taking form of reduced elemental metals or unreduced compounds due to heating or reduction reactions in the furnace, but exist in a liquid or solid state in a region remote from the arcs.

Although only iron (Fe) is used as an example of the metal element constituting the metal oxide agglomerates with carbonaceous material B as the metal agglomerate raw material and the molten metal 14 in the aforementioned embodiment, nonferrous metals such as Ni, Mn, Cr, and the like may be contained in addition to Fe.

In the aforementioned embodiment, adding the CaO source or MgO source to the metal oxide agglomerates with carbonaceous material B in advance is described as an example of the means for adjusting the basicity of the molten slag. Instead of or in addition to such means, limestone or dolomite may be charged from the raw material charging chutes 4 together with the metal oxide agglomerates with carbonaceous material B, or limestone or dolomite may be charged from chutes that are separate from the raw material charging chutes 4 for the metal oxide agglomerates with carbonaceous material B.

Although carbon composite iron oxide pellets are described as an example of a raw material constituting the raw material layer 12 in the aforementioned embodiment, another metal agglomerate raw material may be used or two or more metal agglomerate raw materials may be used in combination.

A carbonaceous material such as coal or coke may be used for forming the raw material layer 12 in addition to or instead of the metal agglomerate raw material. When a carbonaceous material is used as the raw material for forming the raw material layer 12, the size distribution of the carbonaceous material is preferably adjusted according to the size of the carbon composite iron oxide pellets B so that the carbon composite iron oxide pellets B do not penetrate into gaps in the raw material layer 12.

In the aforementioned embodiment, an example in which the tap hole 7 and the slag tap hole 8 are formed in different side walls opposing each other is described. However, the tap hole 7 and the slag tap hole 8 may be installed in the same side wall or the slag tap hole 8 may be omitted and only the tap hole 7 may be formed so that the molten iron and the molten slag can be discharged through the tap hole 7.

While the present invention has been described in detail and with reference to specific embodiments thereof, it will be apparent to one skilled in the art that various changes and modifications can be made without departing from the spirit and scope of the present invention. The present invention contains subject matter related to Japanese Patent Application Nos. 2009-234362 and 2009-234363 filed in the Japan Patent Office on Oct. 8, 2009, the entire contents of which are incorporated herein by reference.

REFERENCE SIGNS LIST

1 furnace top
1' sloping furnace top
1*a* rising portion
1*b* edge
1*c* step
1*d* downward slanting surface
2 end of the furnace in the width direction
3 exhaust gas duct
4 raw material charging chute
5 electrode
6 secondary combustion burner
7 tap hole
8 slag tap hole
9, 10, 11 partition wall
12 raw material layer
12*a* sloping surface
13 metal agglomerate raw material layer (pellet layer)
14 molten metal layer (molten iron layer)
15 molten slag layer
16 furnace bottom
16' sloping furnace bottom
16*a* rising portion
17 access hole
18 shock generator
18*a* shaft
18*b* disintegrating member
19 slanting-surface portion
20 stepped portion
21, 21' bearing
A carbonaceous material (coal)
A' raw material for forming the raw material layer (carbon composite iron oxide pellets)
B metal agglomerate raw material (metal oxide agglomerates with carbonaceous material, carbon composite iron oxide pellets)
C oxygen-containing gas (oxygen)

The invention claimed is:

1. An apparatus for manufacturing molten metal, comprising:

a stationary non-tilting electric furnace including an electric heating device and having a furnace top;

a secondary combustion burner provided in the furnace top;

an exhaust gas duct connected to the furnace top; and a raw material charging chute connected to the furnace top and provided on one end of the furnace in a width direction of the furnace, wherein the electric heating device is provided such that an electric heating region heated with the electric heating device is on the other end of the furnace in the width direction, the furnace top includes a sloping furnace top having a portion that generally slopes downward from the one end of the furnace in the width direction to a lowest position of the furnace top, the secondary combustion burner is provided in the sloping furnace top and positioned between the one end of the furnace and the lowest position of the furnace top, the sloping furnace top has a stepped structure, and the secondary burner is positioned horizontally in the stepped structure.

2. An apparatus for manufacturing molten metal, comprising:

a stationary non-tilting electric furnace including an electric heating device and having a furnace top;

a secondary combustion burner provided in the furnace top;

an exhaust gas duct connected to the furnace top; and a plurality of raw material charging chutes connected to the furnace top and provided on both ends of the furnace in a width direction of the furnace, wherein the electric heating device is provided such that an electric heating region heated with the electric heating device is in a center position of the furnace in the width direction, the furnace top includes a sloping furnace top that generally slopes downward from both ends of the furnace in the width direction to the center position of the furnace in the width direction, the secondary combustion burner is provided in the sloping furnace top and positioned between the one end of the furnace and the center position of the furnace, the sloping furnace top has a stepped structure, and the secondary burner is positioned horizontally in the stepped structure.

3. The apparatus for manufacturing molten metal according to claim 1, wherein the sloping furnace top has a sloping angle in a range of θ1 or more and θ2 or less, the raw material charging chute is configured such that a metal agglomerate raw material is supplied to the furnace in manufacturing molten metal in the apparatus, θ1 equals to a collapse angle of the metal agglomerate raw material minus 15°, and θ2 equals to a static angle of repose of the metal agglomerate raw material plus 15°.

4. The apparatus for manufacturing molten metal according to claim 1, wherein the electric heating device includes an electrode inserted through the furnace top into the furnace and the secondary combustion burner is provided in the sloping furnace top at an angle such that an oxygen-containing gas blown through the secondary combustion burner flows away from the electrode.

5. The apparatus for manufacturing molten metal according to claim 1, wherein the secondary combustion burner has a gas blowing portion configured such that an oxygen-containing gas blown through the secondary combustion burner swirls about an axis of the secondary combustion burner.

6. The apparatus for manufacturing molten metal according to claim 1, further comprising a shock generator that is disposed, within the stationary non-tilting electric furnace, between a furnace bottom of the furnace and a surface of a metal agglomerate raw material layer to be formed by a metal agglomerate raw material supplied through the raw material charging chute to the furnace in manufacturing molten metal in the apparatus.

7. The apparatus for manufacturing molten metal according to claim 6, wherein the shock generator includes a shaft having a rotational axis lying in a longitudinal direction of the furnace and a disintegrating member protruding from a surface of the shaft.

8. The apparatus for manufacturing molten metal according to claim 7, wherein the shock generator is configured to rotate about the rotational axis in one direction only in which the metal agglomerate raw material layer descends or alternately in the direction in which the metal agglomerate raw material layer descends and in a direction opposite to the direction.

9. An apparatus for manufacturing molten metal, comprising:

a stationary non-tilting electric furnace including an electric heating device, the furnace having a furnace top and a furnace bottom;

a secondary combustion burner provided in the furnace top;

an exhaust gas duct connected to the furnace top; and a raw material charging chute connected to the furnace top, wherein the raw material charging chute is provided on one end of the furnace in a width direction of the furnace, the electric heating device is provided such that an electric heating region heated with the electric heating device is on the other end of the furnace in the width direction, the furnace bottom of the furnace includes a sloping furnace bottom having a portion that generally slopes downward from the one end of the furnace in the width direction to a lowest position of the furnace bottom where a molten metal is to be formed, and the sloping furnace bottom has an access hole at a position higher than the lowest position of the furnace bottom, the sloping furnace bottom includes a slanting-surface portion and a stepped portion that are alternately located in a longitudinal direction of the furnace, a plurality of shock generators are disposed at least in the longitudinal direction of the furnace, within the furnace, between the sloping furnace bottom that generally slopes downward and a surface of a metal agglomerate raw material layer to be formed by a metal agglomerate raw material supplied through the raw material charging chute to the furnace in manufacturing molten metal in the apparatus, the shock generators include a shaft having a rotational axis lying in the longitudinal direction of the furnace and a disintegrating member protruding from a surface of the shaft, at least one end of the shaft is supported by a bearing disposed, outside the furnace, below the slanting-surface portion of the sloping furnace bottom, and a portion of the shaft from which the disintegrating member is protruded is disposed, inside the furnace, above the stepped portion of the sloping furnace bottom.

10. The apparatus for manufacturing molten metal according to claim 9, wherein the sloping furnace bottom has a sloping angle in a range of θ3 or more and θ4 or less, the raw material charging chute is configured such that a metal agglomerate raw material is supplied to the furnace in manufacturing molten metal in the apparatus, θ3 equals to a collapse angle of the metal agglomerate raw material minus 25°, and θ4 equals to a static angle of repose of the metal agglomerate raw material plus 5°.

11. An apparatus for manufacturing molten metal, comprising:

a stationary non-tilting electric furnace including an electric heating device, the furnace having a furnace top and a furnace bottom;

a secondary combustion burner provided in the furnace top;

an exhaust gas duct connected to the furnace top; and a plurality of raw material charging chutes connected to the furnace top, wherein the raw material charging chutes are provided in both ends of the furnace in a width direction of the furnace, the electric heating device is provided such that an electric heating region heated with the electric heating device is in a center position of the furnace in the width direction, the furnace bottom of the furnace includes a sloping furnace bottom that generally slopes downward from both ends of the furnace in the width direction to the center position of the furnace in the width direction, and the sloping furnace bottom has an access hole at a position higher than the furnace bottom in the center position of the furnace, the sloping furnace bottom includes a slanting-surface portion and a stepped portion that are alternately located in a longitudinal direction of the furnace, a plurality of shock generators are disposed at least in the longitudinal direction of the furnace, within the furnace, between the sloping furnace bottom that generally slopes downward and a surface of a metal agglomerate raw material layer to be formed by a metal agglomerate raw material supplied through the raw material charging chute to the furnace in manufacturing molten metal in the apparatus, the shock generators include a shaft having a rotational axis lying in the longitudinal direction of the furnace and a disintegrating member protruding from a surface of the shaft, at least one end of the shaft is supported by a bearing disposed, outside the furnace, below the slanting-surface portion of the sloping furnace bottom, and a portion of the shaft from which the disintegrating member is protruded is disposed, inside the furnace, above the stepped portion of the sloping furnace bottom.

* * * * *